US011205568B2

(12) United States Patent
Verenchikov

(10) Patent No.: US 11,205,568 B2
(45) **Date of Patent: *Dec. 21, 2021**

(54) ION INJECTION INTO MULTI-PASS MASS SPECTROMETERS

(71) Applicant: Micromass UK Limited, Wilmslow (GB)

(72) Inventor: Anatoly Verenchikov, Bar (ME)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/636,873

(22) PCT Filed: Jul. 26, 2018

(86) PCT No.: PCT/GB2018/052104

§ 371 (c)(1),
(2) Date: Feb. 5, 2020

(87) PCT Pub. No.: WO2019/030476

PCT Pub. Date: Feb. 14, 2019

(65) Prior Publication Data

US 2020/0373144 A1 Nov. 26, 2020

(30) Foreign Application Priority Data

Aug. 6, 2017 (GB) ..... 1712612
Aug. 6, 2017 (GB) ..... 1712613
(Continued)

(51) Int. Cl.
*H01J 49/40* (2006.01)
*H01J 49/00* (2006.01)
(Continued)

(52) U.S. Cl.
CPC ..... *H01J 49/406* (2013.01); *H01J 49/0031* (2013.01); *H01J 49/022* (2013.01);
(Continued)

(58) Field of Classification Search
CPC .... H01J 49/406; H01J 49/0031; H01J 49/061; H01J 49/22; H01J 49/022; H01J 49/025; H01J 49/067; H01J 49/401; H01J 49/4245
See application file for complete search history.

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

International Search Report and Written Opinion for International Application No. PCT/US2016/062174 dated Mar. 6, 2017, 8 pages.
(Continued)

*Primary Examiner* — Wyatt A Stoffa
(74) *Attorney, Agent, or Firm* — Kacvinsky Daisak Bluni PLLC

(57) ABSTRACT

An improved multi-pass time-of-flight or electrostatic trap mass spectrometer (70) with an orthogonal accelerator, applicable to mirror based multi-reflecting (MR) or multi-turn (MT) analyzers. The orthogonal accelerator (64) is tilted and after first ion reflection or turn the ion packets are back deflected with a compensated deflector (40) by the same angle α to compensate for the time-front steering and for the chromatic angular spreads. The focal distance of
(Continued)

deflector (40) is control by Matsuda plates or other means for producing quadrupolar field in the deflector. Interference with the detector rim is improved with dual deflector (68). The proposed improvements allow substantial extension of flight path and number of ion turns or reflections. The problems of analyzer angular misalignments by tilting of ion mirror (71) is compensated by electrical adjustments of ion beam (63) energy and deflection angles in deflectors (40) and (68).

16 Claims, 8 Drawing Sheets

(30) Foreign Application Priority Data

| | | |
|---|---|---|
| Aug. 6, 2017 | (GB) | 1712614 |
| Aug. 6, 2017 | (GB) | 1712616 |
| Aug. 6, 2017 | (GB) | 1712617 |
| Aug. 6, 2017 | (GB) | 1712618 |
| Aug. 6, 2017 | (GB) | 1712619 |

(51) Int. Cl.
*H01J 49/02* (2006.01)
*H01J 49/06* (2006.01)
*H01J 49/42* (2006.01)

(52) U.S. Cl.
CPC ..... *H01J 49/025* (2013.01); *H01J 49/061* (2013.01); *H01J 49/067* (2013.01); *H01J 49/401* (2013.01); *H01J 49/4245* (2013.01)

(56) References Cited

U.S. PATENT DOCUMENTS

| | | | | |
|---|---|---|---|---|
| 4,691,160 | A | 9/1987 | Ino | |
| 4,731,532 | A | 3/1988 | Frey et al. | |
| 4,855,595 | A | 8/1989 | Blanchard | |
| 5,017,780 | A * | 5/1991 | Kutscher | H01J 49/405 250/287 |
| 5,107,109 | A | 4/1992 | Stafford, Jr. et al. | |
| 5,128,543 | A | 7/1992 | Reed et al. | |
| 5,202,563 | A | 4/1993 | Cotter et al. | |
| 5,331,158 | A | 7/1994 | Dowell | |
| 5,367,162 | A | 11/1994 | Holland et al. | |
| 5,396,065 | A | 3/1995 | Myerholtz et al. | |
| 5,435,309 | A | 7/1995 | Thomas et al. | |
| 5,464,985 | A | 11/1995 | Cornish et al. | |
| 5,619,034 | A | 4/1997 | Reed et al. | |
| 5,654,544 | A | 8/1997 | Dresch | |
| 5,689,111 | A | 11/1997 | Dresch et al. | |
| 5,696,375 | A | 12/1997 | Park et al. | |
| 5,719,392 | A | 2/1998 | Franzen | |
| 5,763,878 | A | 6/1998 | Franzen | |
| 5,777,326 | A | 7/1998 | Rockwood et al. | |
| 5,834,771 | A | 11/1998 | Yoon et al. | |
| 5,955,730 | A | 9/1999 | Kerley et al. | |
| 5,994,695 | A | 11/1999 | Young | |
| 6,002,122 | A | 12/1999 | Wolf | |
| 6,013,913 | A | 1/2000 | Hanson | |
| 6,020,586 | A | 2/2000 | Dresch et al. | |
| 6,080,985 | A | 6/2000 | Welkie et al. | |
| 6,107,625 | A | 8/2000 | Park | |
| 6,160,256 | A | 12/2000 | Ishihara | |
| 6,198,096 | B1 | 3/2001 | Le Cocq | |
| 6,229,142 | B1 | 5/2001 | Bateman et al. | |
| 6,271,917 | B1 | 8/2001 | Hagler | |
| 6,300,626 | B1 | 10/2001 | Brock et al. | |
| 6,316,768 | B1 | 11/2001 | Rockwood et al. | |
| 6,337,482 | B1 | 1/2002 | Francke | |
| 6,384,410 | B1 | 5/2002 | Kawato | |
| 6,393,367 | B1 | 5/2002 | Tang et al. | |
| 6,437,325 | B1 | 8/2002 | Reilly et al. | |
| 6,455,845 | B1 | 9/2002 | Li et al. | |
| 6,469,295 | B1 | 10/2002 | Park | |
| 6,489,610 | B1 | 12/2002 | Barofsky et al. | |
| 6,504,148 | B1 | 1/2003 | Hager | |
| 6,504,150 | B1 | 1/2003 | Verentchikov et al. | |
| 6,534,764 | B1 | 3/2003 | Verentchikov et al. | |
| 6,545,268 | B1 | 4/2003 | Verentchikov et al. | |
| 6,570,152 | B1 | 5/2003 | Hoyes | |
| 6,576,895 | B1 | 6/2003 | Park | |
| 6,580,070 | B2 | 6/2003 | Cornish et al. | |
| 6,591,121 | B1 | 7/2003 | Madarasz et al. | |
| 6,614,020 | B2 | 9/2003 | Cornish | |
| 6,627,877 | B1 | 9/2003 | Davis et al. | |
| 6,646,252 | B1 | 11/2003 | Gonin | |
| 6,647,347 | B1 | 11/2003 | Roushall et al. | |
| 6,664,545 | B2 | 12/2003 | Kimmel et al. | |
| 6,683,299 | B2 | 1/2004 | Fuhrer et al. | |
| 6,694,284 | B1 | 2/2004 | Nikoonahad et al. | |
| 6,717,132 | B2 | 4/2004 | Franzen | |
| 6,734,968 | B1 | 5/2004 | Wang et al. | |
| 6,737,642 | B2 | 5/2004 | Syage et al. | |
| 6,744,040 | B2 | 6/2004 | Park | |
| 6,744,042 | B2 | 6/2004 | Zajfman et al. | |
| 6,747,271 | B2 | 6/2004 | Gonin et al. | |
| 6,770,870 | B2 | 8/2004 | Vestal | |
| 6,782,342 | B2 | 8/2004 | LeGore et al. | |
| 6,787,760 | B2 | 9/2004 | Belov et al. | |
| 6,794,643 | B2 | 9/2004 | Russ, IV et al. | |
| 6,804,003 | B1 | 10/2004 | Wang et al. | |
| 6,815,673 | B2 | 11/2004 | Plomley et al. | |
| 6,833,544 | B1 | 12/2004 | Campbell et al. | |
| 6,836,742 | B2 | 12/2004 | Brekenfeld | |
| 6,841,936 | B2 | 1/2005 | Keller et al. | |
| 6,861,645 | B2 | 3/2005 | Franzen | |
| 6,864,479 | B1 | 3/2005 | Davis et al. | |
| 6,870,156 | B2 | 3/2005 | Rather | |
| 6,870,157 | B1 | 3/2005 | Zare | |
| 6,872,938 | B2 | 3/2005 | Makarov et al. | |
| 6,888,130 | B1 * | 5/2005 | Gonin | H01J 49/027 250/281 |
| 6,900,431 | B2 | 5/2005 | Belov et al. | |
| 6,906,320 | B2 | 6/2005 | Sachs et al. | |
| 6,940,066 | B2 | 9/2005 | Makarov et al. | |
| 6,949,736 | B2 | 9/2005 | Ishihara | |
| 7,034,292 | B1 | 4/2006 | Whitehouse et al. | |
| 7,071,464 | B2 | 7/2006 | Reinhold | |
| 7,084,393 | B2 | 8/2006 | Fuhrer et al. | |
| 7,091,479 | B2 | 8/2006 | Hayek | |
| 7,126,114 | B2 | 10/2006 | Chernushevich | |
| 7,196,324 | B2 | 3/2007 | Verentchikov | |
| 7,217,919 | B2 | 5/2007 | Boyle et al. | |
| 7,221,251 | B2 | 5/2007 | Menegoli et al. | |
| 7,326,925 | B2 | 2/2008 | Verentchikov et al. | |
| 7,351,958 | B2 | 4/2008 | Vestal | |
| 7,365,313 | B2 | 4/2008 | Fuhrer et al. | |
| 7,385,187 | B2 | 6/2008 | Verentchikov et al. | |
| 7,388,197 | B2 | 6/2008 | McLean et al. | |
| 7,399,957 | B2 | 7/2008 | Parker et al. | |
| 7,423,259 | B2 | 9/2008 | Hidalgo et al. | |
| 7,498,569 | B2 | 3/2009 | Ding | |
| 7,501,621 | B2 | 3/2009 | Willis et al. | |
| 7,504,620 | B2 | 3/2009 | Sato et al. | |
| 7,521,671 | B2 | 4/2009 | Kirihara et al. | |
| 7,541,576 | B2 | 6/2009 | Belov et al. | |
| 7,582,864 | B2 | 9/2009 | Verentchikov | |
| 7,608,817 | B2 | 10/2009 | Flory | |
| 7,663,100 | B2 | 2/2010 | Vestal | |
| 7,675,031 | B2 | 3/2010 | Konicek et al. | |
| 7,709,789 | B2 | 5/2010 | Vestal et al. | |
| 7,728,289 | B2 | 6/2010 | Naya et al. | |
| 7,745,780 | B2 | 6/2010 | McLean et al. | |
| 7,755,036 | B2 | 7/2010 | Satoh | |
| 7,772,547 | B2 * | 8/2010 | Verentchikov | H01J 49/406 250/287 |
| 7,800,054 | B2 | 9/2010 | Fuhrer et al. | |
| 7,825,373 | B2 | 11/2010 | Willis et al. | |
| 7,863,557 | B2 | 1/2011 | Brown | |
| 7,884,319 | B2 | 2/2011 | Willis et al. | |

(56) References Cited

U.S. PATENT DOCUMENTS 7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Grinfeld et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov et al.
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1* 2/2007 Verentchikov ..... H01J 49/406 250/281
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0206250 A1 8/2009 Wollnik
2009/0250607 A1 10/2009 Staats et al.
2009/0272890 A1 11/2009 Ogawa et al.
2009/0314934 A1* 12/2009 Brown ..... H01J 49/408 250/282
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2013/0048852 A1* 2/2013 Verenchikov ..... H01J 49/0031 250/282
2013/0056627 A1* 3/2013 Verenchikov ..... H01J 49/06 250/282
2013/0068942 A1* 3/2013 Verenchikov ..... H01J 49/401 250/282
2013/0187044 A1 7/2013 Ding et al.
2013/0240725 A1 9/2013 Makarov
2013/0248702 A1 9/2013 Makarov

(56) References Cited

U.S. PATENT DOCUMENTS

| | | | | |
|---|---|---|---|---|
| 2013/0256524 | A1 | 10/2013 | Brown et al. | |
| 2013/0313424 | A1 | 11/2013 | Makarov et al. | |
| 2013/0327935 | A1 | 12/2013 | Wiedenbeck | |
| 2014/0054454 | A1* | 2/2014 | Hoyes | H01J 49/40 250/282 |
| 2014/0054456 | A1 | 2/2014 | Kinugawa et al. | |
| 2014/0084156 | A1 | 3/2014 | Ristroph et al. | |
| 2014/0117226 | A1 | 5/2014 | Giannakopulos | |
| 2014/0138538 | A1 | 5/2014 | Hieftje et al. | |
| 2014/0183354 | A1 | 7/2014 | Moon et al. | |
| 2014/0191123 | A1 | 7/2014 | Wildgoose et al. | |
| 2014/0217275 | A1* | 8/2014 | Ding | H01J 49/4245 250/282 |
| 2014/0239172 | A1* | 8/2014 | Makarov | H01J 49/02 250/282 |
| 2014/0291503 | A1 | 10/2014 | Shchepunov et al. | |
| 2014/0312221 | A1 | 10/2014 | Verenchikov et al. | |
| 2014/0361162 | A1 | 12/2014 | Murray et al. | |
| 2015/0028197 | A1 | 1/2015 | Grinfeld et al. | |
| 2015/0028198 | A1* | 1/2015 | Grinfeld | H01J 49/4245 250/282 |
| 2015/0034814 | A1 | 2/2015 | Brown et al. | |
| 2015/0048245 | A1 | 2/2015 | Vestal et al. | |
| 2015/0060656 | A1 | 3/2015 | Ugarov | |
| 2015/0122986 | A1 | 5/2015 | Haase | |
| 2015/0194296 | A1 | 7/2015 | Verenchikov et al. | |
| 2015/0228467 | A1 | 8/2015 | Grinfeld et al. | |
| 2015/0279650 | A1* | 10/2015 | Verenchikov | H01J 49/0031 250/282 |
| 2015/0294849 | A1 | 10/2015 | Makarov et al. | |
| 2015/0318156 | A1 | 11/2015 | Loyd et al. | |
| 2015/0364309 | A1 | 12/2015 | Welkie | |
| 2015/0380233 | A1 | 12/2015 | Verenchikov | |
| 2016/0005587 | A1 | 1/2016 | Verenchikov | |
| 2016/0035558 | A1 | 2/2016 | Verenchikov et al. | |
| 2016/0079052 | A1 | 3/2016 | Makarov | |
| 2016/0024036 | A1 | 8/2016 | Verenchikov | |
| 2016/0225598 | A1 | 8/2016 | Ristroph | |
| 2016/0225602 | A1 | 8/2016 | Ristroph et al. | |
| 2016/0240363 | A1* | 8/2016 | Verenchikov | H01J 49/06 |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0098533 | A1* | 4/2017 | Stewart | H01J 49/063 |
| 2017/0168031 | A1* | 6/2017 | Verenchikov | H01J 49/067 |
| 2017/0229297 | A1 | 8/2017 | Green et al. | |
| 2017/0338094 | A1* | 11/2017 | Verenchikov | H01J 49/406 |
| 2018/0144921 | A1 | 5/2018 | Hoyes et al. | |
| 2018/0229297 | A1 | 8/2018 | Funakoshi et al. | |
| 2018/0315589 | A1 | 11/2018 | Oshiro | |
| 2018/0366312 | A1 | 12/2018 | Hamish et al. | |
| 2019/0180998 | A1* | 6/2019 | Stewart | H01J 49/40 |
| 2019/0206669 | A1* | 7/2019 | Verenchikov | H01J 49/061 |
| 2019/0237318 | A1 | 8/2019 | Brown | |
| 2019/0360981 | A1* | 11/2019 | Verenchikov | H01J 49/061 |
| 2020/0083034 | A1 | 3/2020 | Hoyes et al. | |
| 2020/0090919 | A1 | 3/2020 | Artaev et al. | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1* | 5/2020 | Verenchikov | H01J 49/061 |
| 2020/0243322 | A1* | 7/2020 | Stewart | H01J 49/406 |
| 2020/0373142 | A1* | 11/2020 | Verenchikov | H01J 49/405 |
| 2020/0373143 | A1* | 11/2020 | Verenchikov | H01J 49/405 |
| 2020/0373145 | A1* | 11/2020 | Verenchikov | H01J 49/164 |

FOREIGN PATENT DOCUMENTS

| | | | |
|---|---|---|---|
| CN | 102131563 | A | 7/2011 |
| CN | 201946564 | U | 8/2011 |
| DE | 4310106 | C1 | 10/1994 |
| DE | 10116536 | A | 10/2002 |
| DE | 102015121830 | A1 | 6/2017 |
| DE | 102019129108 | A1 | 6/2020 |
| DE | 112015001542 | B4 | 7/2020 |
| EP | 0237259 | A2 | 9/1987 |
| EP | 1137044 | A2 | 9/2001 |
| EP | 1566828 | A2 | 8/2005 |
| EP | 1901332 | A1 | 3/2008 |
| EP | 2068346 | A2 | 6/2009 |
| EP | 1665326 | B1 | 4/2010 |
| EP | 1789987 | A4 | 9/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | A | 3/2015 |
| JP | 2015185306 | B2 | 10/2015 |
| RU | 2564443 | C2 | 5/2017 |
| RU | 2015148627 | A | 5/2017 |
| RU | 2660655 | C2 | 7/2018 |
| SU | 198034 | | 9/1991 |
| SU | 1681340 | A1 | 9/1991 |
| SU | 1725289 | A1 | 4/1992 |
| WO | 9103071 | A1 | 3/1991 |
| WO | 13045428 | A1 | 4/1992 |
| WO | 1998001218 | A1 | 1/1998 |
| WO | 98008244 | A2 | 2/1998 |
| WO | 200077823 | A2 | 12/2000 |
| WO | 2005001878 | A2 | 1/2005 |
| WO | 2006014984 | A1 | 2/2006 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |

(56) References Cited

FOREIGN PATENT DOCUMENTS

| | | | |
|---|---|---|---|
| WO | 2010008386 | A1 | 1/2010 |
| WO | 2010034630 | A2 | 4/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 13063587 | A2 | 5/2013 |
| WO | 2013067366 | A2 | 5/2013 |
| WO | 13093587 | A1 | 6/2013 |
| WO | 2013098612 | A1 | 7/2013 |
| WO | 13110587 | A2 | 8/2013 |
| WO | 13124207 | A1 | 8/2013 |
| WO | 2013110588 | A2 | 8/2013 |
| WO | 2014021960 | A1 | 2/2014 |
| WO | 2014074822 | A1 | 5/2014 |
| WO | 14110697 | A1 | 7/2014 |
| WO | 2014142897 | A1 | 9/2014 |
| WO | 2014152902 | A2 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2016064398 | A1 | 4/2016 |
| WO | 2016174462 | A1 | 11/2016 |
| WO | 2017042665 | A1 | 3/2017 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |

OTHER PUBLICATIONS

IPRP PCT/US2016/062174 issued May 22, 2018, 6 pages.
Search Report for GB Application No. GB1520130.4 dated May 25, 2016.
International Search Report and Written Opinion for International Application No. PCT/US2016/062203 dated Mar. 6, 2017, 8 pages.
Search Report for GB Application No. GB1520134.6 dated May 26, 2016.
IPRP PCT/US2016/062203, issued May 22, 2018, 6 pages.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
Search Report for GB Application No. 1520540.4 dated May 24, 2016.
IPRP for application PCT/US2016/063076, dated May 29, 2018, 7 pages.
IPRP PCT/GB17/51981 dated Jan. 8, 2019, 7 pages.
International Search Report and Written Opinion for International Application No. PCT/GB2018/051206, dated Jul. 12, 2018, 9 pages.
N/a: "Electrostatic lens," Wikipedia, Mar. 31, 2017 (Mar. 31, 2017), XP055518392, Retrieved from the Internet:URL: https://en.wikipedia.org/w/index.phptitle=Electrostatic lens oldid=773161674[retrieved on Oct. 24, 2018].
Hussein, O.A. et al., "Study the most favorable shapes of electrostatic quadrupole doublet lenses", AIP Conference Proceedings, vol. 1815, Feb. 17, 2017 (Feb. 17, 2017), p. 110003.
Guan S., et al. "Stacked-ring electrostatic ion guide", Journal of the American Society for Mass Spectrometry, Elsevier Science Inc, 7(1):101-106 (1996).
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12, 2017, 5 pages.
Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al., "Fast Ion Mobility Spectrometry and High Resolution TOF MS" ASMS Conference Poster (2014).
Verenchicov, A. N. "Parallel MS-MS Analysis in a Time-Flight Tandem. Problem Statement, Method, and Instrucmental Schemes" Institute for Analytical Instrucmentation RAS, Saint-Petersburg, (2004).
Yavor, M. I. "Planar Multireflection Time-Of-Flight Mass Analyser with Unlimited Mass Range" Institute for Analytical Instrucmentation RAS, Saint-Petersburg, (2004).
Khasin, Y. I. et al. "Initial Experimenatl Studies of a Planar Multireflection Time-Of-Flight Mass Spectrometer" Institute for Analytical Instrucmentation RAS, Saint-Petersburg, (2004).
Verenchicov, A. N. et al. "Stability of Ion Motion in Periodic Electrostatic Fields" Institute for Analytical Instrucmentation RAS, Saint-Petersburg, (2004).
Verenchicov, A. N. "The Concept of Mutireflecting Mass Spectrometer for Continuous Ion Sources" Institute for Analytical Instrucmentation RAS, Saint-Petersburg, (2006).
Verenchicov., A. N., et al. "Accurate Mass Measurements for Inerpreting Spectra of atmospheric Pressure Ionization" Institute for Analytical Instrucmentation RAS, Saint-Petersburg, (2006).

(56) References Cited

OTHER PUBLICATIONS

Kozlov, B. N. et al., "Experimental Studies of Space Charge Effects in Multireflecting Time-Of-Flight Mass Spectrometes" Institute for Analytical Instrucmentation RAS, Saint-Petersburg, (2006).
Kozlov, B. N. et al., "Multireflecting Time-Of-Flight Mass Spectrometer With an Ion Trap Source" Institute for Analytical Instrucmentation RAS, Saint-Petersburg, (2006).
Hasin, Y. I., et al., "Planar Time-Of-Flight Multireflecting Mass Spectrometer with an Orthogonal Ion Injection Out of Continuous Ion Sources" Institute for Analytical Instrucmentation RAS, Saint-Petersburg, (2006).
Lutvinsky Y. I. et al., "Estimation of Capacity of High Resolution Mass Spectra for Analysis of Complex Mixtures" Institute for Analytical Instrucmentation RAS, Saint-Petersburg, (2006).
International Search Report and Written Opinion for International application No. PCT/GB2020/050209, dated Apr. 28, 2020, 12 pages.
Verenchicov, A. N. et al. "Multiplexing in Multi-Reflecting TOF MS" Journal of Applied Solution Chemistry and Modeling, 6:1-22(2017).
Supplementary Partial EP Search Report for EP Application No. 16869126.9, dated Jun. 13, 2019.
Supplementary Partial EP Search Report for EP Application No. 16866997.6, dated Jun. 7, 2019.
Reflectron—Wikipedia, Oct. 9, 2015, Retrieved from the Internet URL:https://en.wikipedia.org/w/index.phptitle=Reflectron oldid=684843442 [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Sakurai et al., "A New Multi-Passage Time-of-Flight Mass Spectrometer at JAIST", Nuclear Instruments Methods in Physics Research, Section A, Elsevier, 427(1-2): 182-186, May 11, 1999.
Toyoda et al., "Multi-Turn-Time-of-Flight Mass Spectometers with Electrostatic Sectors", Journal of Mass Spectrometry, 38: 1125-1142, Jan. 1, 2003.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet: URL:https://www.etp-ms.com/file-repository/21 [retrieved on Jul. 31, 2019].
Kaufmann, R., et. al., "Sequencing of peptides in a time-of-flight mass spectrometer: evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB2018/051320 dated Aug. 1, 2018.
International Search Report and Written Opinion for International Application No. PCT/GB2019/051839 dated Sep. 18, 2019.
International Search Report and Written Opinion for International Application No. PCT/GB2019/051234 dated Jul. 29, 2019.
Extended European Search Report for EP Patent Application No. 16866997.6, dated Oct. 16, 2019.
Search Report under Section 17(5) for GB1916445.8, dated Jun. 15, 2020.
IPRP for International application No. PCT/GB2018/051206, issued on Nov. 5, 2019, 7 pages.
Combined Search and Examination Report for United Kingdom Application No. GB1901411.7 dated Jul. 31, 2019.
Examination Report for United Kingdom Application No. GB1618980.5 dated Jul. 25, 2019.
Combined Search and Examination Report for GB1906258.7, dated Oct. 25, 2019.
Combined Search and Examination Report for GB1906253.8, dated Oct. 30, 2019, 5 pages.
Author unknown, "Einzel Lens", Wikipedia [online] Nov. 2020 [retrieved on Nov. 3, 2020]. Retrieved from Internet URL: https://en.wikipedia.org/wiki/Einzel_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Carey, D.C., "Why a second-order magnetic optical achromat works", Nucl. Instrum. Meth., 189(203):365-367 (1981). Abstract.
Sakurai, T. et al., "Ion optics for time-of-flight mass spectrometers with multiple symmetry", Int J Mass Spectrom Ion Proc 63(2-3):273-287 (1985). Abstract.
Wollnik, H., and Casares, A., "An energy-isochronous multi-pass time-of-flight mass spectrometer consisting of two coaxial electrostatic mirrors", Int J Mass Spectrom 227:217-222 (2003). Abstract.
Examination Report under Section 18(3) for Application No. GB1906258.7, dated May 5, 2021, 4 pages.
O'Halloran, G.J., et al., "Determination of Chemical Species Prevalent in a Plasma Jet", Bendix Corp Report ASD-TDR-62-644, U.S. Air Force (1964). Abstract.

* cited by examiner $D_x$
$D_z$
d
d
N
N-2
N-4
$U_z$=80eV; N=30
68
67
ΔZ
69
17
16
16
40
ψ
$Z_0$
γ
$\alpha_1$
$\alpha_2$
β
65
66
64
63
62
62
61
61
13
12
11
$U_z$
60
X
Z

ION INJECTION INTO MULTI-PASS MASS SPECTROMETERS

CROSS-REFERENCE TO RELATED APPLICATIONS

This application is a U.S. national phase filing under 35 U.S.C. § 371 claiming the benefit of and priority to International Patent Application No. PCT/GB2018/052104, filed on Jul. 26, 2018, which claims priority from and the benefit of United Kingdom patent application No. 1712612.9, United Kingdom patent application No. 1712613.7, United Kingdom patent application No. 1712614.5, United Kingdom patent application No. 1712616.0, United Kingdom patent application No. 1712617.8, United Kingdom patent application No. 1712618.6 and United Kingdom patent application No. 1712619.4, each of which was filed on Aug. 6, 2017. The entire content of these applications is incorporated herein by reference.

FIELD OF INVENTION

The invention relates to the area of multi-pass time-of-flight mass spectrometers (MPTOF MS) [e.g. multi-turn (MT) and multi-reflecting (MR) TOF MS with orthogonal pulsed converters, and electrostatic ion trap mass spectrometers E-Trap MS], and is particularly concerned with improved injection mechanism and control over drift ion motion in MPTOF analyzers.

BACKGROUND

Orthogonal accelerators are widely used in time-of-flight mass spectrometers (TOF MS) to form ion packets from intrinsically continuous ion sources, like Electron Impact (EI), Electrospray (ESI), Inductively couple Plasma (ICP) and gaseous Matrix Assisted Laser Desorption and Ionization (MALDI) sources. Initially, the orthogonal acceleration (OA) method has been introduced by Bendix corporation in 1964. Dodonov et. al. in SU1681340 and WO9103071 improved the OA injection method by using an ion mirror to compensate for multiple inherent OA aberrations. The beam propagates in the drift Z-direction through a storage gap between plate electrodes. Periodically, an electrical pulse is applied between plates. A portion of continuous ion beam, in the storage gap, is accelerated in an orthogonal X-direction, thus forming ribbon-shaped ion packets. Due to conservation of initial Z-velocity, ion packets drift slowly in the Z-direction, thus traveling within the TOF MS along an inclined mean ion trajectory, get reflected by an ion mirror and finally reach a detector.

The resolution of a Time of Flight mass spectrometer (TOFMS) has recently been improved by using multi-pass TOFMS (MPTOF), employing either ion mirrors for multiple ion reflections in a multi-reflecting TOFMS (MRTOF mass spectrometer), e.g. as described in SU1725289, U.S. Pat. Nos. 6,107,625, 6,570,152, GB2403063, U.S. Pat. No. 6,717,132, or employing electrostatic sectors for multiple ion turns in a multi-turn TOFMS (MTTOF mass spectrometer), e.g. as described in U.S. Pat. Nos. 7,504,620 and 7,755,036, incorporated herein by reference. The term "pass" generalizes ion mirror reflection in MRTOFs and ion turns in MTTOFs. The resolution of MPTOF mass spectrometers grows with increasing numbers of passes N, by reducing the effect of the initial time spread of ion packets and of the detector time spread. MPTOF analyzers are arranged to fold ion trajectories for substantial extension of ion flight path (e.g. over 10-50 m) within commercially reasonable size (e.g. 0.5-1 m) instruments.

By nature, the electrostatic 2D-fields of MPTOF mass analysers have zero electric field component ($E_Z$=0) in the drift Z-direction, i.e. they have no effect on the ion packet's free propagation and its expansion in the drift Z-direction. Most of MPTOF mass analysers employ orthogonal accelerators (OA). Specific energy per charge (controlled by source bias) $K_Z$ of continuous ion beam is preserved by ion packets within the MPTOF mass analyser, thus, defining the inclination angle $\alpha$ of ion packets for a certain energy $K_X$ of accelerated ion packets, so as the energy spread $\Delta K_Z$ then defines the initial angular spread $\Delta\alpha$:

$$\alpha=(K_Z/K_X)^{0.5};\ \Delta\alpha=\alpha*\Delta K_Z/(2K_Z) \quad \text{(eq. 1)}$$

To fit multiple turns (for the purpose of higher resolution), the ion beam energy $K_Z$ shall be reduced, usually under 10V, diminishing efficiency of ion beam injection into OA. Denser folding of the ion paths results in a problem of bypassing the rims of the OA and ion detector. The inevitable ion packets angular divergence $\Delta\alpha$ of a few mrad at low $K_Z$ converts into tens of mm spatial spread at the detector, causing ion losses if using skimming slits.

As understood by the inventor and not yet recognized in the field, a major problem with the performance of MPTOF mass analysers using OA injection is caused by minor misalignments of ion mirrors or sectors. Those misalignments affect free ion propagation in the drift Z-direction, and what is much more important, cause time fronts of ion packets to become tilted, affecting MPTOF isochronicity. Those effects are aggregated by mixing of ion packets at multiple reflections or turns, since time front tilting is different for initially wide parallel ion packets and for initially diverging ion packets.

The prior art proposes complex methods to define the ion drift motion and to confine the angular divergence of ion packets. For example, U.S. Pat. No. 7,385,187 proposed a periodic lens and edge deflectors for MRTOF instruments; U.S. Pat. No. 7,504,620 proposed laminated sectors for MTTOF instruments; WO2010008386 and then US2011168880 proposed quasi-planar ion mirrors having weak (but sufficient) spatial modulation of mirror fields; U.S. Pat. No. 7,982,184 proposed splitting mirror electrodes into multiple segments for arranging $E_Z$ field; U.S. Pat. No. 8,237,111 and GB2485825 proposed electrostatic traps with three-dimensional fields, though without sufficient isochronicity in all three dimensions and without non-distorted regions for ion injection; WO2011086430 proposed first order isochronous Z-edge reflections by tilting ion mirror edge combined with reflector fields; U.S. Pat. No. 9,136,101 proposed bent ion MRTOF ion mirrors with isochronicity recovered by trans-axial lens. However, those solutions have limited power and no methods were developed for compensating analyzer misalignments.

Various embodiments of the present invention provide an efficient mechanism of ion injection into MPTOF mass analyser, improve control over ion drift motion in the analyser; and provide mechanisms and methods of compensating minor analyzer misalignments to improve analyzer isochronicity. Various embodiments provide an MPTOF instrument with a resolution of R>80,000 at an ion flight path length of over 10 m for separating major isobaric interferences. This may be achieved in a compact and low cost instrument with a size of about 0.5 m or under, and without stressing requirements of the detection system and affecting peak fidelity.

SUMMARY

From a first aspect the present invention provides a mass spectrometer comprising: a multi-pass time-of-flight mass analyzer or electrostatic ion trap having an orthogonal accelerator and electrodes arranged and configured so as to provide an ion drift region that is elongated in a drift direction (z-dimension) and to reflect or turn ions multiple times in an oscillating dimension (x-dimension) that is orthogonal to the drift direction; and an ion deflector located downstream of said orthogonal accelerator, and that is configured to back-steer the average ion trajectory of the ions, in the drift direction, and to generate a quadrupolar field for controlling the spatial focusing of the ions in the drift direction.

The ion deflector is configured to back-steer the average ion trajectory of the ions, in the drift direction. The average ion trajectory of the ions travelling through the ion deflector may have a major velocity component in the oscillation dimension (x-dimension) and a minor velocity component in the drift direction. The ion deflector back-steers the average ion trajectory of the ions passing therethrough by reducing the velocity component of the ions in the drift direction. The ions may therefore continue to travel in the same drift direction upon entering and leaving the ion deflector, but with the ions leaving the ion deflector having a reduced velocity in the drift direction. This enables the ions to oscillate a relatively high number of times in the oscillation dimension, for a given length in the drift direction, thus providing a relatively high resolution.

However, it has been recognised that a conventional ion deflector inherently has a relatively high focusing effect on the ions, hence undesirably increasing the angular spread of the ion trajectories exiting the deflector, as compared to the angular spread of the ion trajectories entering the ion deflector. This may cause excessive spatial defocusing of the ions downstream of the focal point, resulting in ion losses and/or causing ions to undergo different numbers of oscillations in the spectrometer before they reach the detector. This may cause spectral overlap due to ions from different ion packets being detected at the same time. The mass resolution of the spectrometer may also be adversely affected. Such conventional ion deflectors are therefore particularly problematic in multi-pass time-of-flight mass analysers or multi-pass electrostatic ion traps, since a large angular spread of the ions will cause any given ion packet to diverge a relatively large amount over the relatively long flight path through the device. Embodiments of the present invention provide an ion deflector configured to generate a quadrupolar field that controls the spatial focusing of the ions in the drift direction, e.g. so as to maintain substantially the same angular spread of the ions passing therethrough, or to allow only the desired amount of spatial focusing of the ions in the z-direction.

The quadrupolar field for in the drift direction may generate the opposite ion focusing or defocusing effect in the dimension orthogonal to the drift direction and oscillation dimension. However, it has been recognised that the focal properties of MPTOF mass analyser (e.g. MRTOF mirrors) or electrostatic trap are sufficient to compensate for this.

The multi-pass time-of-flight mass analyser may be a multi-reflecting time of flight mass analyser having two ion mirrors that are elongated in the drift direction (z-dimension) and configured to reflect ions multiple times in the oscillation dimension (x-dimension), wherein the orthogonal accelerator is arranged to receive ions and accelerate them into one of the ion mirrors; or the multi-pass time-of-flight mass analyser may be a multi-turn time of flight mass analyser having at least two electric sectors configured to turn ions multiple times in the oscillation dimension (x-dimension), wherein the orthogonal accelerator is arranged to receive ions and accelerate them into one of the sectors.

Where the mass analyser is a multi-reflecting time of flight mass analyser, the mirrors may be gridless mirrors.

Each mirror may be elongated in the drift direction and may be parallel to the drift dimension.

It is alternatively contemplated that the multi-pass time-of-flight mass analyser or electrostatic trap may have one or more ion mirror and one or more sector arranged such that ions are reflected multiple times by the one or more ion mirror and turned multiple times by the one or more sector, in the oscillation dimension.

The mass analyser or electrostatic trap may be an isochronous and/or gridless mass analyser or an electrostatic trap.

The mass analyser or electrostatic trap may be configured to form an electrostatic field in a plane defined by the oscillation dimension and the dimension orthogonal to both the oscillation dimension and drift direction (i.e. the XY-plane).

This two-dimensional field may have a zero or negligible electric field component in the drift direction (in the ion passage region). This two-dimensional field may provide isochronous repetitive multi-pass ion motion along a mean ion trajectory within the XY plane.

The energy of the ions received at the orthogonal accelerator and the average back steering angle of the ion deflector may be configured so as to direct to an ion detector after a pre-selected number of ion passes (i.e. reflections or turns).

The spectrometer may comprise an ion source. The ion source may generate an substantially continuous ion beam or ion packets.

The orthogonal accelerator may be a gridless orthogonal accelerator.

The orthogonal accelerator has a region for receiving ions (a storage gap) and may be configured to pulse ions orthogonally to the direction along which it receives ions. The orthogonal accelerator may receive a substantially continuous ion beam or packets of ions, and may pulse out ion packets.

The drift direction may be linear (i.e. a dimension) or it may be curved, e.g. to form a cylindrical or elliptical drift region.

The mass analyser or ion trap may have a dimension in the drift direction of: ≤1 m; ≤0.9 m; ≤0.8 m; ≤0.7 m; ≤0.6 m; or ≤0.5 m. The mass analyser or trap may have the same or smaller size in the oscillation dimension and/or the dimension orthogonal to the drift direction and oscillation dimension.

The mass analyser or ion trap may provide an ion flight path length of: between 5 and 15 m; between 6 and 14 m; between and 13 m; or between 8 and 12 m.

The mass analyser or ion trap may provide an ion flight path length of: ≤20 m; ≤15 m; ≤14 m; ≤13 m; ≤12 m; or ≤11 m. Additionally, or alternatively, the mass analyser or ion trap may provide an ion flight path length of: ≥5 m; ≥6 m; ≥7 m; ≥8 m; ≥9 m; or ≥10 m. Any ranges from the above two lists may be combined where not mutually exclusive.

The mass analyser or ion trap may be configured to reflect or turn the ions N times in the oscillation dimension, wherein N is: ≥5; ≥6; ≥7; ≥8; ≥9; ≥10; ≥11; ≥12; ≥13; ≥14; ≥15; ≥16; ≥17; ≥18; ≥19; or ≥20. The mass analyser or ion trap may be configured to reflect or turn the ions N times in the oscillation dimension, wherein N is: ≤20; ≤19; ≤18; ≤17;

≤16; ≤15; ≤14; ≤13; ≤12; or ≤11. Any ranges from the above two lists may be combined where not mutually exclusive.

The spectrometer may have a resolution of: ≥30,000; ≥40,000; ≥50,000; ≥60,000; ≥70,000; or ≥80,000.

The spectrometer may be configured such that the orthogonal accelerator received ions having a kinetic energy of: ≥20 eV; ≥30 eV; ≥40 eV; ≥50 eV; ≥60 eV; between 20 and 60 eV; or between 30 and 50 eV. Such ion energies may reduce angular spread of the ions and cause the ions to bypass the rims of the orthogonal accelerator.

The spectrometer may comprise an ion detector.

The detector may be an image current detector configured such that ions passing near to it induce an electrical current in it. For example, the spectrometer may be configured to oscillate ions in the oscillation dimension proximate to the detector, inducing a current in the detector, and the spectrometer may be configured to determine the mass to charge ratios of these ions from the frequencies of their oscillations (e.g. using Fourier transform technology). Such techniques may be used in the electrostatic ion trap embodiments.

Alternatively, the ion detector may be an impact ion detector that detects ions impacting on a detector surface. The detector surface may be parallel to the drift dimension.

The ion detector may be arranged between the ion mirrors or sectors, e.g. midway between (in the oscillation dimension) opposing ion mirrors or sectors.

The ion deflector may be configured to generate a substantially quadratic potential profile in the drift direction.

The ion deflector may back steers all ions passing therethrough by the same angle; and/or may control the spatial focusing of the ion packet in the drift direction such that the ion packet has substantially the same size in the drift dimension when it reaches an ion detector in the spectrometer as it did when it enters the ion deflector.

The ion deflector may the spatial focusing of the ion packet in the drift direction such that the ion packet has a smaller size in the drift dimension when it reaches a detector in the spectrometer than it did when it entered the ion deflector.

The spectrometer may comprise at least one voltage supply configured to apply one or more first voltage to one or more electrode of the ion deflector for performing said back-steer and one or more second voltage to one or more electrode of the ion deflector for generating said quadrupolar field for said spatial focusing, wherein the one or more first voltage is decoupled from the one or more second voltage.

The ion deflector may comprise at least one plate electrode arranged substantially in the plane defined by the oscillation dimension and the dimension orthogonal to both the oscillation dimension and the drift direction (X-Y plane), wherein the plate electrode is configured back-steer the ions; and wherein the ion deflector comprises side plate electrodes arranged substantially orthogonal to the opposing electrodes and that are maintained at a different potential to the opposing electrodes for controlling the spatial focusing of the ions in the drift direction.

The side plates may be Matsuda plates.

The at least one plate electrode may comprise two electrodes and a voltage supply for applying a potential difference between the electrodes so as to back-steer the average ion trajectory of the ions, in the drift direction.

The two electrodes may be a pair of opposing electrodes that are spaced apart in the drift direction.

However, it is contemplated that only the upstream electrode (in the drift direction) may be provided, so as to avoid ions hitting the downstream electrode.

The ion deflector may be configured to provide said quadrupolar field by comprising one or more of: (i) a trans-axial lens/wedge; (iii) a deflector with aspect ratio between deflecting plates and side walls of less than 2; (iv) a gate shaped deflector; or (v) a toroidal deflector such as a toroidal sector.

The ion deflector may focus the ions in a y-dimension that is orthogonal to the drift direction and the oscillation dimension, and wherein the orthogonal accelerator and/or mass analyser or electrostatic ion trap is configured to compensate for this focusing.

For example, the orthogonal accelerator and/or mass analyser or electrostatic ion trap may defocus the ions in the y-dimension.

In embodiments where the multi-pass time-of-flight mass analyser is a multi-reflecting time of flight mass analyser having ion mirrors, the ion mirrors may compensate for the y-focusing caused by the ion deflector. In embodiments where the multi-pass time-of-flight mass analyser is a multi-turn time of flight mass analyser having sectors, the sectors may compensate for the y-focusing caused by the ion deflector.

The ion deflector may be arranged such that it receives ions that have already been reflected or turned in the oscillation dimension by the multi-pass time-of-flight mass analyser or electrostatic ion trap; optionally after the ions have been reflected or turned only a single time in the oscillation dimension by the multi-pass time-of-flight mass analyzer or electrostatic ion trap.

The location of the deflector directly after the first ion mirror reflection allows yet denser ray folding.

The orthogonal accelerator may be arranged and configured to receive ions along an ion receiving axis that is tilted at an angle to the drift direction, in a plane defined by the drift direction and the oscillation dimension (XZ-plane), and to pulse the ions orthogonally to the ion receiving axis such that the time front of the ions exiting the orthogonal accelerator is parallel to the ion receiving axis. The ion deflector may be configured to back-steer the ions, in the drift direction, such that the time front of the ions becomes parallel, or more parallel, to the drift dimension and/or an impact surface of an ion detector after the ions exit the ion deflector.

For the avoidance of doubt, the time front of the ions may be considered to be a leading edge/area of ions in the ion packet having the same mass (and optionally the mean average energy).

The ion receiving axis may be tilted at an acute tilt angle $\beta$ to the drift direction; wherein the ion deflector back steers ions passing therethrough by a back-steer angle $\psi$, and wherein the tilt angle and back-steer angle are the same.

It is believed that it had not previously been recognised that the combination of the tilting of the orthogonal accelerator and the ion deflector back steering may compensate for the chromatic angular spread of the ions by the ion deflector at exactly the same condition.

Ion injection may be improved by tilting the orthogonal accelerators as described above, since it allows the ion beam energy at the entrance to the orthogonal accelerator to be increased, thereby reducing angular spread of the ions and causing the ions to bypass the rims of the orthogonal accelerator. The orthogonal accelerator may be tilted to the drift direction by an acute angle, e.g. several degrees.

The spectrometer may comprise an ion optical lens for spatially focusing or compressing the ion packet in the drift direction, wherein the ion deflector is configured to defocus the ion packet in the drift direction, and wherein the combination of the ion optical lens and ion deflector are configured to provide telescopic compression of the ion beam.

The ion optical lens may be located between the orthogonal accelerator and the ion deflector.

The ion optical lens may be a trans-axial lens, and may be combined with trans-axial wedge for both focusing and deflection.

The wedge lens referred to herein may generate equipotential field lines that diverge, converge or curve as a function of position along the drift direction (Z-direction). For example, this may be achieved by two electrodes that are spaced apart by an elongated gap that is curved along the longitudinal axis of the gap. Alternatively, this may be achieved by two electrodes that are spaced apart by a wedge-shaped gap.

The spectrometer may comprise an ion optical lens for compressing the ion packet in the drift direction by a factor C; wherein said orthogonal accelerator is arranged and configured to receive ions along an ion receiving axis that is tilted at an angle $\beta$ to the drift direction, in a plane defined by the drift direction and the oscillation dimension (XZ-plane); wherein the ion deflector is configured to back-steer the ions, in the drift direction, by angle $\psi$, and wherein $\beta=\psi/C$.

The inventor has discovered that this relationship compensates for the tilted time front caused by the orthogonal ion accelerator.

The combination of the ion optical lens and ion deflector may be configured to provide telescopic compression of the ion beam.

The spectrometer may comprise a further ion deflector proximate an ion detector in the spectrometer for deflecting the average ion trajectory such that ions are guided onto a detecting surface of the detector.

This avoids ions impacting on inactive regions of the detector, such as its rims.

The further deflector may deflect ions after the final and/or penultimate reflection or turn in the oscillation dimension.

An intermediate ion optical lens (e.g. Einzel lens or trans-axial lens) may be arranged between the orthogonal accelerator and ion detector for providing additional focusing and/or steering of the ions. This lens may be arranged to have a relatively long focal length (e.g. 5-10 m or more).

The ions may pass through the intermediate ion optical lens at least four times as they are reflected in the mirrors or turned in the sectors.

The present invention also provides a method of mass spectrometry comprising: providing the spectrometer described herein; transmitting ions into the orthogonal accelerator along an ion receiving axis; accelerating the ions orthogonally to the ion receiving axis in the orthogonal accelerator; and deflecting the ions downstream of said orthogonal accelerator so as to back-steer the average ion trajectory of the ions, in the drift direction, and controlling the spatial focusing of the ions in the drift direction with the quadrupolar field; wherein the ions are oscillated multiple times in the oscillation dimension by the multi-pass time-of-flight mass analyser or electrostatic ion trap as the ions drift through the drift region in the drift direction.

The present invention also provides a mass spectrometer comprising: a multi-pass time-of-flight mass analyzer or electrostatic ion trap having an orthogonal accelerator and electrodes arranged and configured so as to provide an ion drift region that is elongated in a drift direction (z-dimension) and to reflect or turn ions multiple times in an oscillating dimension (x-dimension) that is orthogonal to the drift direction; and an ion deflector located downstream of said orthogonal accelerator, and that is configured to back-steer the average ion trajectory of the ions, in the drift direction, and to compensate for changes in the angular spread of the ions that would be caused by the back-steering.

This aspect may have any of the features described above in relation to the first aspect. For example the compensating for the changes in the angular spread of the ions may be performed by configuring the ion deflector to generate a quadrupolar field for controlling the spatial focusing of the ions in the drift direction.

A range of improvements is proposed for ion injection mechanism into MPTOF MS analyzers, either MRTOF or MPTOF, with two dimensional electrostatic fields and free ion drift in the Z-direction. The improvements are also applicable to other isochronous electrostatic ion analyzers, such as electrostatic traps and open traps, so as to electrostatic analyzers with generally curved drift axis, such as cylindrical trap, or elliptical TOF MS.

Problems of conventional MPTOF instruments have been recognized, which are created by low injection energy of continuous ion beam, by insufficient folding of ion packets caused by the necessity of bypassing rims of OA and detector, by the ion packet divergence and, which is most important, by parasitic effects of components misalignments. It was recognized that those problems can be solved with an improved ion injection mechanism, combining the OA tilting with the beam steering by compensated deflectors, and then adjusting parameters of the injection for compensating the misalignments.

An embodiment of the present invention provides a time-of-flight mass spectrometer comprising:

(a) An isochronous gridless electrostatic multi-pass (multi-reflecting or multi-turn) time-of-flight mass analyzer or an electrostatic trap, built of electrodes, substantially elongated in first drift Z-direction, to form an electrostatic field in an XY-plane, being orthogonal to said Z-direction; said two-dimensional field has zero or negligible field $E_Z$ component in the ion passage region; said two-dimensional field provides for an isochronous repetitive multi-pass ion motion along a mean ion trajectory within the XY-plane;

(b) An ion source, generating an ion beam substantially along the drift Z-axis;

(c) An orthogonal gridless accelerator for admitting said ion beam into a storage gap and for pulsed ion accelerating in the orthogonal to said ion beam direction, thus forming ion packets;

(d) A time-of-flight or image current detector;

(e) Wherein said orthogonal accelerator is tilted within XZ-plane at an inclination angle $\alpha$ (f) At least one electrostatic deflector located after said accelerator and within the first ion pass—reflection or turn; said deflector is arranged for back steering of said ion packets in the drift Z-direction; wherein the energy of said ion beam and said steering angle are adjusted for directing ions onto said detector after a desired number of ion passes and for mutual compensation of the ion packet's time front tilt and of the chromatic angular spreads, produced individually by said tilted accelerator tilt and said deflector.

Preferably, the spectrometer may further comprise means for introducing quadrupolar field within said at least one deflector for compensating the over-focusing of said deflector and for controlling the focal distance of the deflector in the Z-direction; wherein ion packet focusing by said means in the transverse Y-direction is compensated by tuning of said analyzer or of said gridless accelerator.

Preferably, means for introducing quadrupolar field may comprise one of the group: (i) trans-axial lens/wedge; (ii) Matsuda plate or torroidal deflector; (iii) deflector with aspect ratio between deflecting plates and side walls of less than 2; (iv) gate shaped deflector; or (v) torroidal deflector.

Preferably, the spectrometer may further comprise a dual deflector arranged for ion packet displacement at mutual compensation of the time-front tilt; wherein said dual deflector may be used either for ion bypassing the accelerator or detector rim, or for improved transmission between said accelerator and said at least one deflector; or for telescopic compression of ion packets, or for ion reversing in the drift Z-direction; or for the tuning of ion packets time-front tilt T|Z or for compensating ion packets time-front bend T|ZZ.

Preferably, said isochronous gridless analyzer may be part of one of the group: (i) multi-reflecting or multi-turn time-of-flight mass spectrometer; (ii) multi-reflecting or multi-turn open trap; and (iii) multi-reflecting or multi-turn ion trap. Preferably, said drift Z-axis is generally curved to form cylindrical or elliptical analyzers and alike.

An embodiment of the present invention provides a method of mass spectrometric analysis comprising the following steps:

(a) Forming a two-dimensional electrostatic field within an XY-plane, substantially elongated in the mutually orthogonal drift Z-direction; said two-dimensional field provides for an isochronous repetitive multi-pass (multi-reflecting or multi-turn) ion motion along a mean ion trajectory within the XY-plane; said two-dimensional field has zero or negligible field $E_Z$ component in the ion passage region;

(b) Generating an ion beam substantially along the drift Z-axis by an ion source;

(c) Admitting said ion beam into a storage gap of an orthogonal gridless accelerator for pulsed accelerating a portion of said ion beam in the direction being orthogonal to said ion beam, thus forming ion packets;

(d) Detecting said ion packets with a time-of-flight or image current detector;

(e) Wherein said orthogonal accelerator is tilted within XZ-plane at an inclination angle $\alpha$ (f) Back steering of said ion packets in the drift Z-direction by at least one electrostatic deflector located after said accelerator and within the first ion pass—reflection or turn;

(e) Adjusting said deflection angle and said ion beam energy for directing ions onto said detector after a desired number of ion passes and for mutual compensation of the ion packet's time front tilt and of the chromatic angular spreads produced individually by said steps of accelerator tilt and of ion steering in said deflector.

Preferably, the method may further comprise a step of introducing quadrupolar field within said at least one deflector for compensating the over-focusing of said deflector and for controlling the focal distance of the deflector in the Z-direction; wherein ion packet focusing by said quadrupolar field in the Y-direction may be compensated by tuning of said analyzer or of spatial focusing in said gridless accelerator.

Preferably, the method may further comprise a step of ion packet dual steering within adjacent ion passes in a dual deflector, tuned for mutual compensation of the time-front tilt; wherein said dual steering may be used either for ion bypassing the accelerator or detector rim, or for improved transmission between said accelerator and said at least one deflector; or for telescopic compression of ion packets; or for ion reversing in the drift Z-direction; or for the tuning of ion packets time-front tilt T|Z or for compensating ion packets time-front bend T|ZZ.

Preferably, said ion motion within said isochronous two dimensional electric field of said analyzer may be arranged for ion single pass in said drift direction, or for multiple back and forth passes; or for ion trapping by trapping in the drift direction.

Preferably, said drift Z-axis may be generally curved to form cylindrical or elliptical two-dimensional fields.

Preferably, said energy of ion beam and said steering angles are adjusted to compensate for misalignments and imperfection of said pulsed acceleration field, or said isochronous field of analyzer, or of the detector.

Preferably, the method may further comprise a step of ion packet steering and a step of ion packet focusing or defocusing in quadrupolar field, both arranged in-front of the detector, to compensate for components and fields misalignments.

BRIEF DESCRIPTION OF THE DRAWINGS

Various embodiments will now be described, by way of example only, and with reference to the accompanying drawings in which.

DETAILED DESCRIPTION

Figure 1:
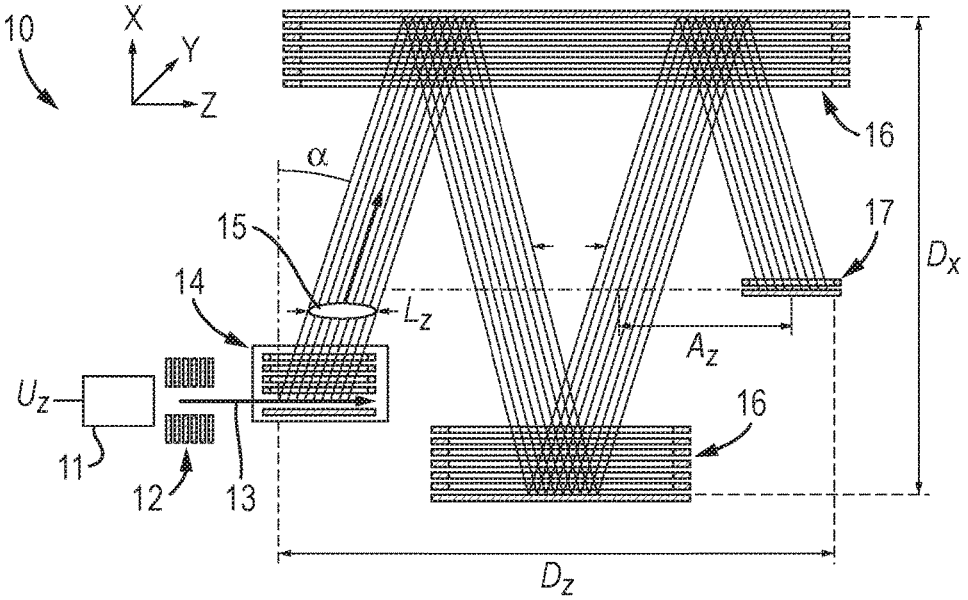
Fig. 1 Prior Art
FIG. 1 shows prior art according to U.S. Pat. No. 6,717,132 having planar multi-reflecting TOF analyser and a gridless orthogonal pulsed accelerator.

Referring to FIG. 1, a prior art multi-reflecting TOF instrument 10 according to U.S. Pat. No. 6,717,132 is shown having an orthogonal accelerator (i.e. an OA-MRTOF instrument). The MRTOF instrument 10 comprises: an ion source 11 with a lens system 12 to form a parallel ion beam 13; an orthogonal accelerator (OA) 14 with a storage gap to admit the beam 13; a pair of gridless ion mirrors 16, separated by field-free drift region, and a detector 17. Both OA 14 and mirrors 16 are formed with plate electrodes having slit openings, oriented in the Z-direction, thus forming a two dimensional electrostatic field, symmetric about the XZ symmetry plane (also denoted as s-plane). Accelerator 14, ion mirrors 16 and detector 17 are parallel to the Z-axis.

In operation, ion source 11 generates continuous ion beam. Commonly, ion sources 11 comprise gas-filled radio-frequency (RF) ion guides (not shown) for gaseous dampening of ion beams. Lens 12 forms a substantially parallel continuous ion beam 13, entering OA 14 along the Z-direction. Electrical pulse in OA 14 ejects ion packets 15. Packets 15 travel in the MRTOF analyser at a small inclination angle $\alpha$ to the x-axis, which is controlled by the ion source bias $U_Z$. After multiple mirror reflections, ion packets hit detector 17. Specific energy of continuous ion beam 13 controls the inclination angle $\alpha$ and number of mirror reflections.

Figure 2:
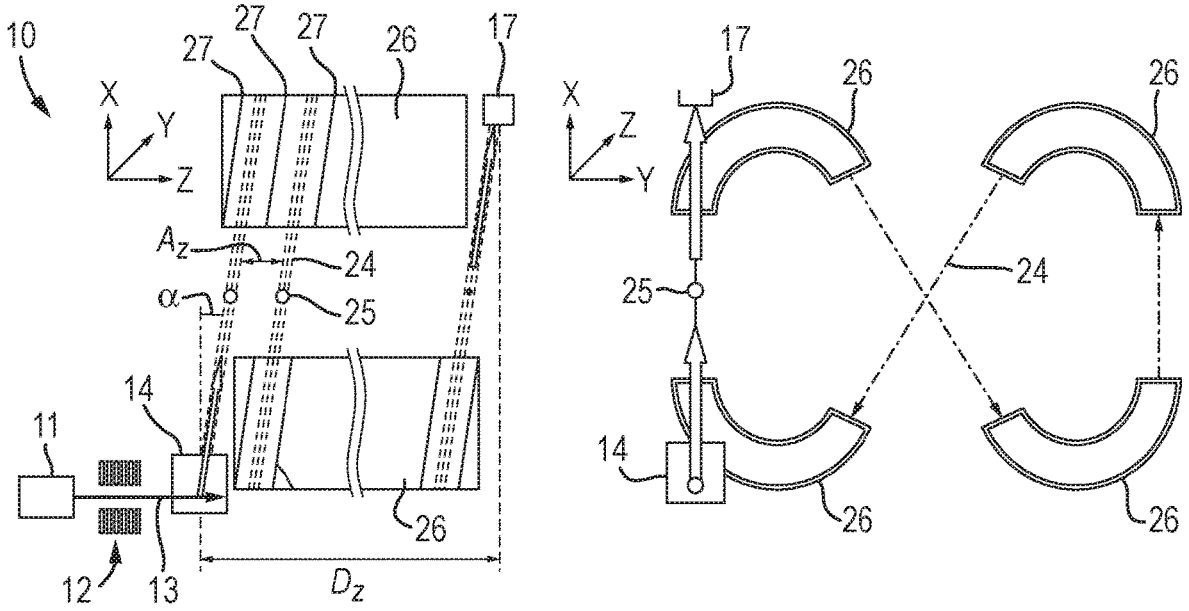
Fig. 2 Prior Art
FIG. 2 shows prior art according to U.S. Pat. No. 7,504,620 having a planar multi-turn TOF mass analyser and an OA.

Referring to FIG. 2, a prior art multi-turn TOF analyzer 20 according to U.S. Pat. No. 7,504,620 is shown having an orthogonal accelerator (i.e. an OA-MRTOF instrument). The instrument comprises: an ion source 11 with a lens system 12 to form a substantially parallel ion beam 13; an orthogonal accelerator (OA) 14 to admit the beam 13; four electrostatic sectors 26 with spiral laminations 27, separated by field-free drift regions, and a TOF detector 17.

Similarly to the arrangement in FIG. 1, the OA 14 admits a slow (say, 10 eV) ion beam 13 and periodically ejects ion packets 25 along a spiral ion trajectory. Electrostatic sectors 26 are arranged isochronous for a spiral ion trajectory 27 with a figure-of-eight shaped ion trajectory 24 in the XY-plane and with a slow advancing in the drift Z-direction corresponding to a fixed inclination angle $\alpha$. The energy $U_Z$ of ion beam 13 is arranged to inject ions at the inclination angle $\alpha_0$, matching a of laminated sectors.

The laminated sectors 27 provide three dimensional electrostatic fields for ion packet 25 confinement in the drift Z-direction along the mean spiral trajectory 24. The fields of the four electrostatic sectors 27 also provide for isochronous ion oscillation along the—figure-of-eight shaped central curved ion trajectory 24 in the XY-plane (also denoted as s). If departing from technically complex lamination, the spiral trajectory may be arranged within two dimensional sectors. However, some means of controlling ion Z-motion are then required, very similar to MRTOF instruments.

The improvements of the embodiments of the present invention are equally applicable to both MRTOF and MTTOF instruments.

Figure 3:
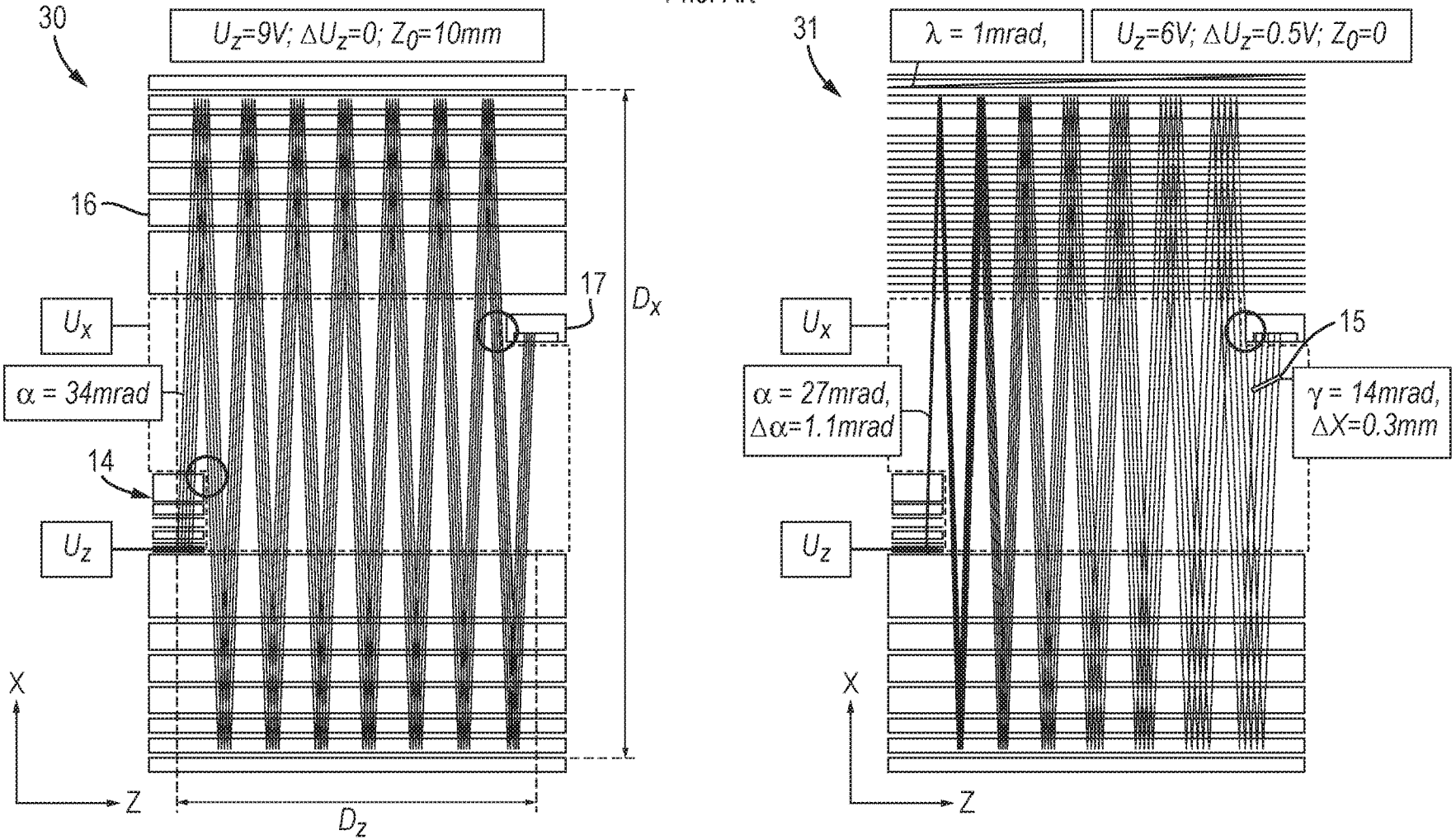
Fig. 3 Prior Art
FIG. 3 illustrates problems of the prior art MRTOF instrument of FIG. 1, i.e. low ion beam energy, limited number of reflections, ions hitting rims of OA and detector, and most important, loss of isochronicity at minor instrumental misalignments.

Referring to FIG. 3, simulation examples 30 and 31 are shown that illustrate problems of prior art MRTOF instruments 10, if pushing for higher resolutions and denser ion trajectory folding. Exemplary MRTOF parameters were used, including: $D_X$=500 mm mirror cap-cap distance; $D_Z$=250 mm wide portion of non-distorted XY-field; acceleration potential is $U_X$=8 kV, OA rim=10 mm and detector rim=5 mm.

In example 30, to fit 14 ion reflections (i.e. L=7 m ion flight path) the source bias is set to $U_Z$=9V. Parallel ion rays with an initial ion packet length in the z-dimension of $Z_0$=10 mm and no angular spread ($\Delta\alpha$=0) start hitting rims of OA 14 and of detector 17. In example 31, the top ion mirror is tilted by $\lambda$=1 mrad, representing a realistic overall effective angle of mirror tilt considering built up faults of stack assemblies, standard accuracy of machining and moderate electrode bend by internal stress at machining. Every "hard" ion reflection in the top ion mirror then changes the inclination angle $\alpha$ by 2 mrad. The inclination angle $\alpha$ grows from $\alpha_1$=27 mrad to $\alpha_2$=41 mard, gradually expanding central trajectory. To hit the detector after N=14 reflections, the source bias has to be reduced to $U_Z$=6V. The angular divergence is amplified by the mirror tilt and increases the ion packets width to $\Delta Z$=18 mm, inducing ion losses on the rims. Obviously, slits in the drift space may be used to avoid trajectory overlaps, however, at a cost of additional ionic losses.

In example 31, the inclination of ion mirror introduces yet another and much more serious problem. The time-front 15 of the ion packet becomes tilted by angle $\gamma$=14 mrad in-front of the detector. The total ion packet spreading in the time-of-flight X-direction $\Delta X=\Delta Z*\gamma$=0.3 mm does limit mass resolution to $R<L/2\Delta X$=11,000 at L=7 m flight path, being low even for a regular TOF instrument and too low for MRTOF instruments. To avoid the limitation, the electrode precision has to be brought to a non-realistic level: $\lambda<0.1$ mrad, translated to better than 10 um accuracy and straightness of individual electrodes.

Thus, attempts of increasing flight path length enforce much lower specific energies $U_Z$ of continuous ion beam and larger angular divergences $\Delta\alpha$ of ion packets, which induce ion losses and may produce spectral overlaps. Small mechanical imperfections also affect MRTOF resolution and require unreasonably high precision.

Various embodiments of the present invention will now be described.

It is desirable to keep instrument size relatively small, e.g. at about 0.5 m, or under. Using larger analyzers raises manufacturing cost close to the cubic power of the instrument size.

Preferably, data system and detector time spreading (at peak base) shall not be pushed under DET=1.5-2 ns. This will avoid expensive ultra-fast detectors with strong signal ringing. It will also avoid artificial sharpening of resolution by "centroid detection" algorithms, ruining mass accuracy and merging mass isobars.

To resolve practically important isobars at mass resolution RTOF/2DET, the peak width shall be less than isobaric mass difference, hence requiring longer flight time TOF and longer flight path L (calculated for 5 kV acceleration), all shown in the Table 1.

TABLE 1

| Replacing elements | Mass difference, mDa | Resolution > (M = 1000 amu) | TOF>, us | Flight Path L>, m |
|---|---|---|---|---|
| C for $H_{12}$ | 94 | 10,600 | 42 | 1.33 |
| O for $CH_4$ | 38.4 | 26,000 | 104 | 3.3 |
| ClH for $C_3$ | 24 | 41,600 | 167 | 5.3 |
| N for $CH_2$ | 12.4 | 80,600 | 320 | 10.1 |

The table presents the most relevant and most frequent isobaric interferences of first isotopes. In case of LC-MS, the required resolution may be over 80,000. In case of GC-MS, where most of ions are under 500 amu, the required resolution may be over 40K.

Thus, various embodiments of the present invention provide an ion flight path over 10 m in length. The mass analyser may also have a size of ≤0.5 m in any one (e.g. horizontal) dimension. The mass analyser may provide N passes (e.g. reflections or turns), where N>20. The analyser may be minimise the effect of aberrations of the ion optical scheme on resolution. Embodiments are able to operate at reasonably high ion beam energy (>30-50 eV) for improved ion beam admission into the orthogonal accelerator.

Embodiments of the invention provide the instrument with sufficient resolution (e.g. R>80,000) and a flight path over 10 m for separating major isobaric interferences, achieved in compact and low cost instrument (e.g. having a size of about 0.5 m or under), without stressing the requirements of the detection system and not affecting peak fidelity.

The below described embodiments are described in relation to particularly compact MRTOF analysers having a size (e.g. in the horizontal dimensions) of 450×250 mm, and operating at 8 kV acceleration voltage. However, other sized instruments and other acceleration voltages are contemplated.

The below described embodiments of the present invention may employ ion deflectors, and optionally, improved deflectors with compensated over-focusing.

Figure 4:
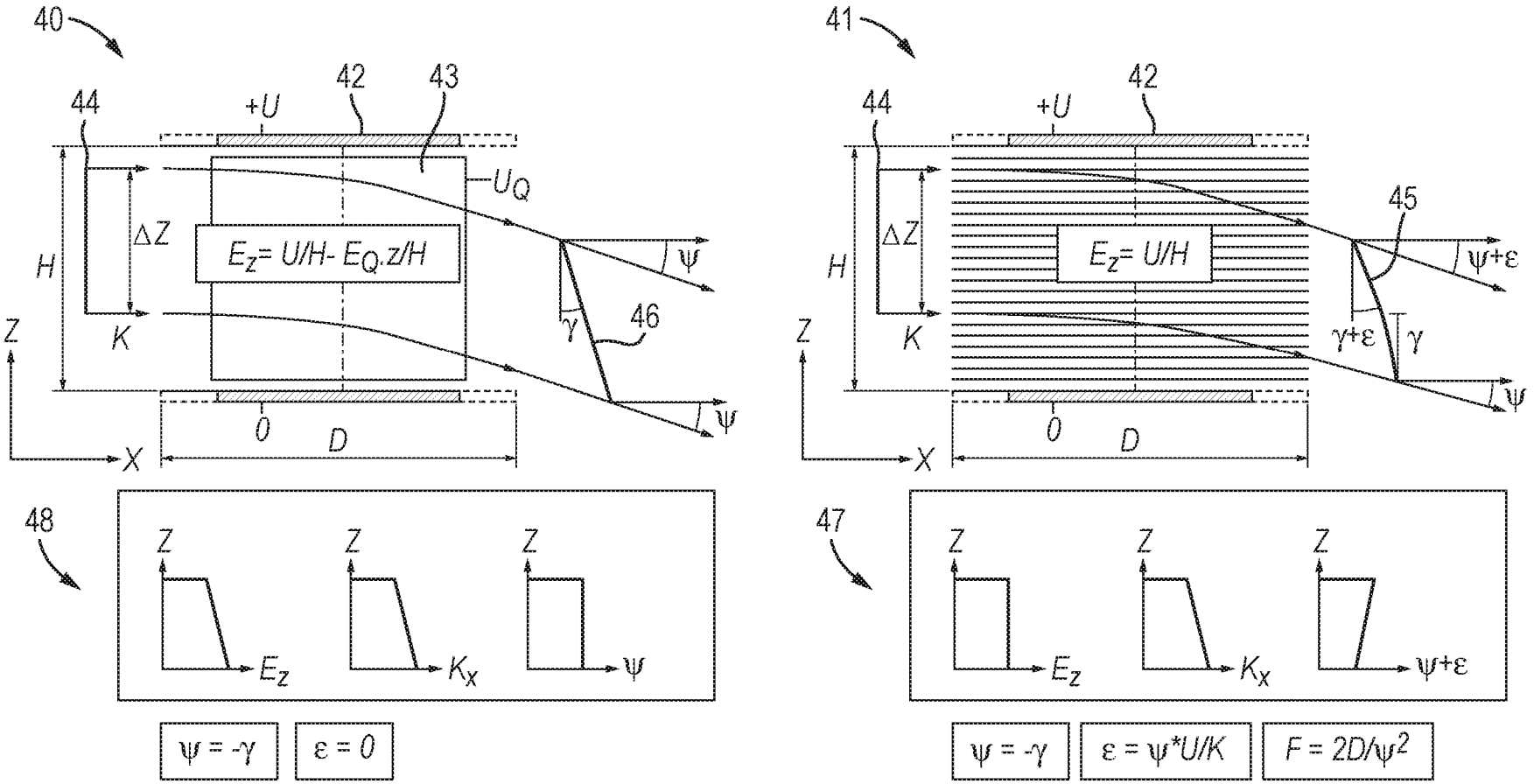
FIG. 4 illustrates the difference between conventional deflectors of the prior art and balanced deflectors of the present invention.
Figure 5:
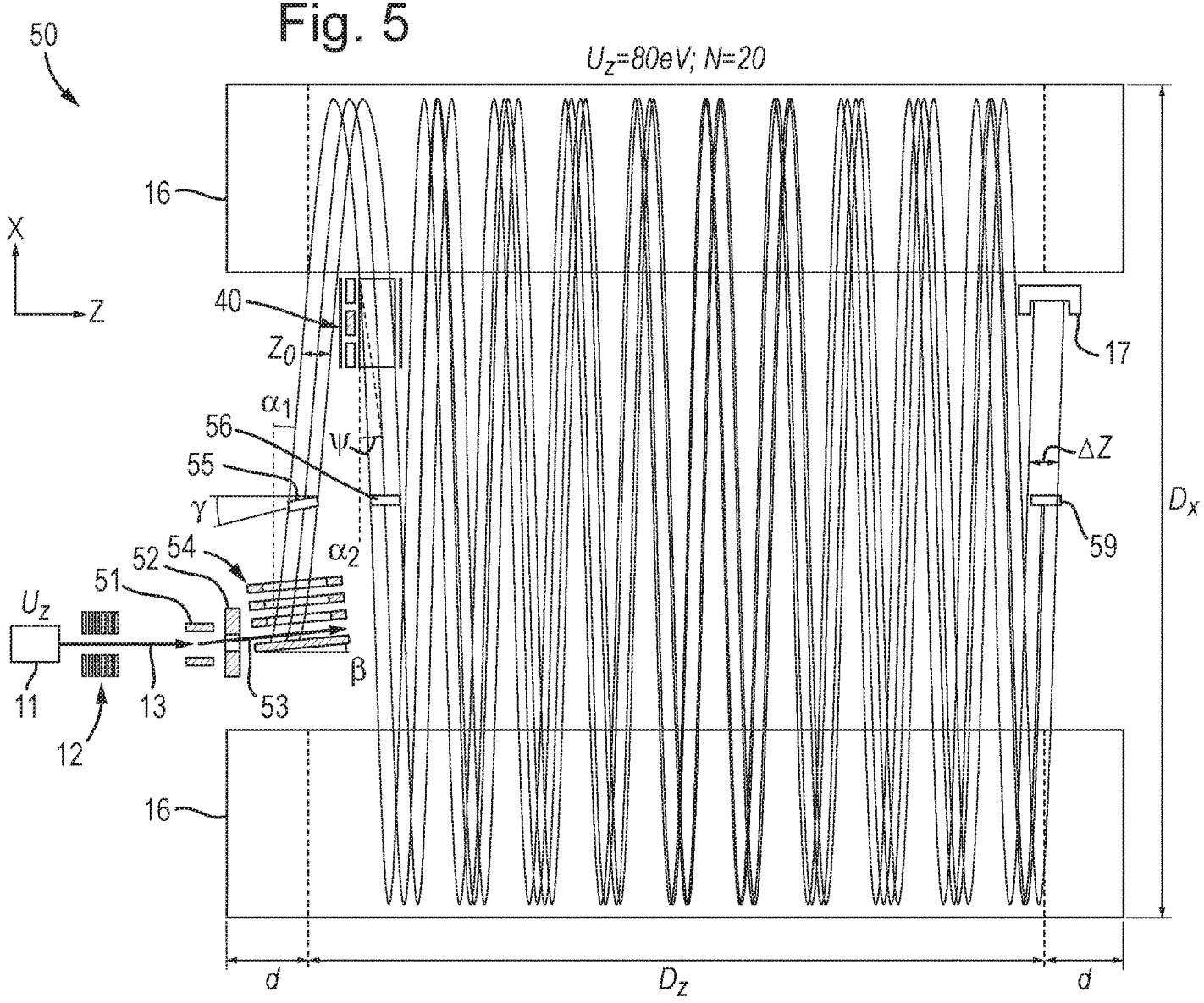
FIG. 5 shows an OA-MRTOF embodiment of the present invention with improved ion injection.

Referring to FIG. 4, there are compared properties of a conventional deflector 41, and of a compensated deflector 40 of an embodiment of the present invention. Such a deflector 40 may be used to deflect ions in the z-dimension (drift dimension) of the mass analyser, e.g. as shown in FIG. 5.

Referring back to FIG. 4, the conventional deflector 41 is composed of pair of parallel deflection plates, spaced by distance H. Potential difference U generates a deflecting field $E_Z U/H$. Accounting for fringing fields, the field acts within distance D in the x-dimension. Ions of mean specific energy K at the lower part of the deflector (as seen in FIG. 4), are deflected by an angle $\psi=D/2H*U/K$. The deflector is known to steer the time front of the ion packet by the opposite angle $\gamma=-\psi$, which becomes evident when accounting that the upper ion rays (shown in FIG. 4) are slowed down within the deflector. The slow down of upper ion rays to U-K specific energy also causes a difference ε (where $\varepsilon=\psi*U/K*z/H$) in the deflection angle and introduces an inevitable angular dispersion and inevitable focusing properties of the deflector with focal distance $F=2D/\psi^2$, where the strength of the focusing effect rapidly increases with the deflection angle amplitude such that:

$$\gamma(z)=-\psi(z)=U/K*D/2H+\varepsilon(z),$$

$$\varepsilon(z)=\psi*U/K*z/H;\ F=2D/\psi^2$$

The inevitable focusing of such conventional deflectors makes them a poor choice for controlling ion drift motion in MPTOF instruments. However, the inventor has recognised that an ion deflector may be used in an advantageous manner.

Again referring to FIG. 4, the deflector 40 according to an embodiment of the present invention may comprise a built-in quadrupolar field (e.g. $E_Z=-2U_Q*z/H^2$) designed for controlled spatial focusing of the ions, and being decoupled from the amplitude of ion steering. The exemplary compensated deflector 40 comprises a pair of opposing deflection plates 42 and also side plates 43 that are maintained at a different potential. Similar side plates for sectors are known as Matsuda plates. The additional quadrupolar field in deflector 40 provides the first order compensation for angular dispersion of conventional deflectors. The compensated deflector 40 steers all the ions by the same angle ψ, tilts the time front of the ion packet by angle $\gamma=-\psi$, and may be capable of compensating the over-focusing (i.e. $F\rightarrow\infty$) while avoiding the bending of the time front. Alternatively, the deflector 40 may be capable of controlling the focal distance F independent of the steering angle ψ. The parameters of the deflector 40 may therefore be given by:

$$E_Z U/H-2U_Q*z/H^2,$$

$$\gamma=-\psi=-D/2H*U/K$$

$$F=D/(\psi^2/2-K/U_Q)$$

The quadrupolar fields allows controlling spatial focusing (at negative $U_Q$) and defocusing (at negative $U_Q$) of the ions by the deflector 40.

The quadrupolar field in the Z direction inevitably generates an opposite focusing or defocusing field in the transverse Y-direction. However, it has been recognised that the focal properties of MPTOF mass analyser (e.g. MRTOF mirrors) are sufficient to compensate for the Y-focusing of the quadrupolar deflectors 40, even without adjustments of ion mirror potentials and without any significant time-of-flight aberrations.

Similar compensated deflectors are proposed to be constructed out of trans-axial (TA) deflectors, formed by wedge electrodes. Similarly to embodiment 40, an embodiment of the invention proposes using a first order correction, produced by an additional curvature of TA-wedge. Third, yet simpler compensated deflector can be arranged with a single potential while selecting the size of Matsuda plates, suitable for a narrower range of deflection angles. The asymmetric deflector is then formed with a deflecting electrode having gate shape, surrounded by shield, set at the drift potential. Forth, similarly (though more complex), the compensated deflector can be arranged with torroidal sector.

As described above, various embodiments provide improved compensated ion deflectors to overcome the over-focusing problem of conventional ion deflectors, so as to control the focal distance of the deflectors, including defocusing by quadrupolar fields. Transverse effects of the quadrupolar field may be well compensated by the spatial and isochronous properties of MPTOF mass analyser.

FIG. 5 shows an embodiment 50 of an MRTOF mass analyser having an orthogonal accelerator. The mass analyser comprises: two parallel gridless ion mirrors 16, elongated in the Z-direction and, separated by a floated drift space; an ion source 11 with a lens system 12 to form a parallel ion beam 13 substantially along or at small angle to the Z-direction; an orthogonal accelerator (OA) 54 tilted to the Z-axis by angle β; a compensated ion deflector 40, located downstream of OA 54, and preferably located after the first ion reflection; and a detector 17, also aligned with the Z-axis.

In operation, ion source 11 generates continuous ion beam at specific energy $U_Z$ (e.g. defined by source 11 bias). Preferably, ion source 11 comprise gas-filled radio-frequency (RF) ion guide (not shown) for gaseous dampening of ion beam 13. Lens 12 forms a substantially parallel continuous ion beam 13. Ion beam 13 may enter OA 54 directly, while tilting at least the exit part of ion optics 12. It is more convenient and preferred to arrange the source along the Z-axis while steering the beam 13 by a deflector 51, followed by collimation of steered beam 53 with a slit 52 and yet preferably by a pair of heated slits for limiting both—the width and the divergence of beam 53.

Beam 53 enters tilted OA 54. An electrical pulse in OA 54 ejects ion packets 55 along a mean ion ray inclined by angle $\alpha_1=\alpha_0-\beta$, where β is the OA tilt angle and $\alpha_0$ is natural inclination angle past OA, which is defined by the ion source bias and the ion energy in the z-dimension Ux: $\alpha_0\ (U_Z/U_X)^{0.5}$. The time front of ion packets 55 stay parallel to the OA 54 and at an angle to the z-dimension of $\gamma=\beta$. In order to increase the number N of mirror reflections (and hence ion path length and resolution), the ion ray inclination angle $\alpha_2$ may be reduced by back steering ion packets in the deflector 40 by angle ψ. This is preferably performed after a single ion mirror reflection (which allows yet denser ray folding). The ion energy $U_Z$, the OA tilt angle β and the back steering angle ψ of deflector 40 may be chosen and tuned so that the back steering angle $\psi$ equals the time-front tilt angle $\gamma$: $\psi=\gamma$. As a result, the time-fronts of ion packets 56 becomes aligned and parallel with the Z-axis. After multiple mirror reflections, ion packets 59 hit detector 17 with time-fronts being parallel to the detector face. Mutual compensation of tilt and steering may occur at the following compensation conditions:

$$\beta=\psi=(\alpha_0-\alpha_1)/2 \text{ where } \alpha_0=(U_Z/U_X)^{0.5} \text{ and } \alpha_1=D_Z/D_X N$$

where $D_Z$ is the distance in the z-dimension from the midpoint of the OA 54 to the midpoint of the detector 17, and $D_X$ is the cap-to-cap distance between the ion mirrors.

It is believed that it had not previously been recognised that the combination of OA tilt and deflector steering does in fact compensate for the chromatic angular spread by the deflector at exactly the same condition:

$$\alpha|K=0 \text{ and } T|Z=0 \text{ at } \beta=\psi$$

A numerical example of an embodiment will now be described, again referring to FIG. 5. The method of compensated injection is illustrated with numbers for the exemplary compact MRTOF mass analyser having $D_X$=450 mm and $D_Z$=250 mm sizes. Note that the exemplary MRTOF mass analyser is shown geometrically distorted. The exemplary MRTOF mass analyser is chosen with positive (retarding) mirror lens electrodes for increasing the acceleration voltage to $U_X$=8 kV at maximal mirror voltage amplitude under 10 kV.

To enhance the ion beam admission into the OA and to reduce the angular divergence of ion packets $\Delta\alpha=\Delta U_Z/2(U_Z*U_X)^{0.5}$, the ion beam specific energy is chosen $U_Z$=80V, which corresponds to $\alpha_0$=100 mrad at $U_X$=8 kV. The ray inclination angle is chosen to be $\alpha_1$=22 mrad to fit N=20 reflections into the compact MRTOF mass analyser, where the ion advance per reflection is $L_Z$=10 mm, i.e. slightly smaller than the ion packets initial width $Z_0$=10 mm. Note that such a small advance $L_Z$ becomes possible because of the optimal location of deflector 40, and because of the improved design of the deflector 40 arranged without the right deflection plate. Then the OA tilt and back steering angles are: $\beta=\psi=(\alpha_0-\alpha_1)/2$=39 mrad to provide for compensated steering while bringing the tilt angle of ion packets 56 to zero.

Choosing higher energy $U_Z$ helps reducing ion packets angular divergence to as low as $\Delta\alpha$=0.6 mrad. After N=20 reflections and L=10 m flight path, ion packets expand by 6 mm only. The potentials of the Matsuda plates in the deflector 40 may be chosen to focus initially parallel and $Z_0$=10 mm wide ion packets into a point. Since chromatic angular spread by the deflector is compensated ($\alpha|K=0$), the final width $\Delta Z$ of the ion packet 56 in-front of the detector is expected to be as low as 6 mm, i.e. allows the shown dense folding of ion trajectory.

Increased the flight path to L=9 m corresponds to a flight time T=225 us for 1000 amu ions at $U_X$=8 kV, thus setting a resolution limit of $R=T/2\Delta T>50{,}000$ when using non stressed detectors with $\Delta T$=2 ns time spread with smaller detector ringing.

As described in relation to FIG. 5, the ion injection mechanism may be strongly improved by tilting the orthogonal accelerators and using a continuous ion beam, which are conventionally oriented in the drift Z-direction. To increase the ion beam energies at the OA entrance, the orthogonal accelerator may be slightly tilted to the drift z-axis by several degrees. At least one compensated deflector of TA-deflector/lens may be used for local steering of ion rays. The combination of tilt and steering may mutually compensate for the time-front tilt ($T|Z=0$ i.e. $\gamma 0$). Increased ion energies improve the ion beam admission into the OA, help bypassing OA rims, and reduce the ion packet angular divergence. Back steering by the deflector allows reducing the ion ray inclination angle, and enables a larger number of ion reflections, thus increasing resolution. The location of the deflector directly after the first ion mirror reflection allows yet denser ray folding. The compensated tilt and steering simultaneously compensates for a chromatic angular spread of ion packets.

If pushing the compact MRTOF mass analyser for higher resolutions, yet denser folding of the ion trajectory may become limited in the embodiment 50 by the ion packet interference with the deflector right wall and with the detector rim.

Figure 6:
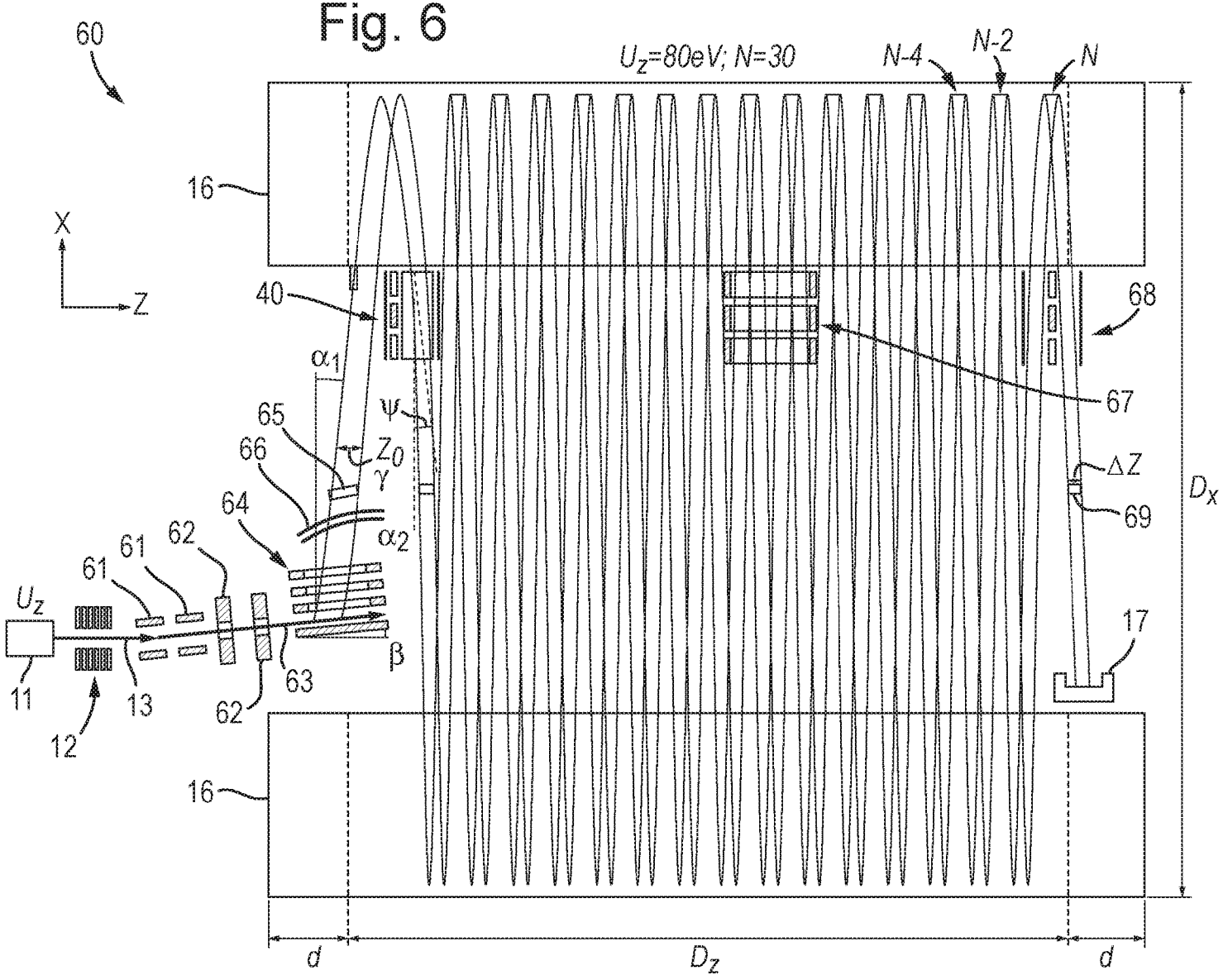
FIG. 6 illustrates improvements of embodiments of the present invention for yet denser ion trajectory folding in MRTOF instruments.

Referring to FIG. 6, another embodiment 60 of an MRTOF mass analyser having an orthogonal accelerator is shown. The mass analyser comprises a number of components similar to those in embodiment 50: two parallel gridless ion mirrors 16; an ion source 11 with a lens system 12; an orthogonal accelerator (OA) 64 tilted by angle $\beta$; a compensated deflector 40 located after first ion reflection; and a detector 17 aligned with the Z-axis. Embodiment 60 further comprises improving elements, which may be used in combination or separately: a trans-axial (TA) wedge/lens 66; a lens (Einzel or trans-axial) 67 surrounding two adjacent ion trajectories; and a dual deflector 68 for ion packets displacement.

Similar to mass analyser 50 of FIG. 5, in the embodiment of FIG. 6, ion source 11 generates a continuous ion beam at specific energy $U_Z$. Lens 12 forms a substantially parallel continuous ion beam 13. The beam is corrected by dual deflector 61, so that the aligned beam 63 matches the common axis of OA 64 and of heated collimator 62, both tilted to the Z-axis by angle $\beta$. Similar to embodiment 50, the combination of tilted OA 64 and deflector 40 allows injecting ion beam at elevated energies, reducing the inclination angle from $\alpha_0$ to $\alpha_1$ in order to fit a larger number of reflections (e.g. N=30), while achieving zero tilt of ion packet 69 ($\gamma$=0), i.e. parallel to the detector 17 face.

The combination of TA-lens/wedge 66 with the compensated deflector 40 allow arranging telescopic compression of the ion packet width, here from 10 mm to 5 mm. While TA lens 66 focuses ion packets to achieve two-fold compression, the potential of the Matsuda plate in the deflector 40 may be adjusted for moderate packet defocusing, so that initially parallel rays with ion packet width $Z_0$=10 mm were spatially focused onto the detector. It is a new finding that with the ion packet spatial compression by factor C between OA 64 and deflector 40 (in this example C=2) there appears newly formulated condition for compensating of the time front tilt $\gamma$=0 (i.e. overall $T|Z=0$), occurring at $\beta=\psi/C$. Thus, the OA tilt angle becomes:

$$\beta=\psi/C=(\alpha_0-\alpha_1)/(1+C)$$

where $\alpha_0=(U_Z/U_X)^{0.5}$ is defined by ion source bias $U_Z$, and $\alpha_1$ is chosen from trajectory folding in MRTOF.

When TA-wedge 67 is used for steering, still $\gamma$=0 may be recovered and relations for angles can be figured out with regular geometric considerations.

To bypass the detector 17 rim, ion packets are preferably displaced by dual deflector 68, preferably also equipped with Matsuda plates. The dual symmetric deflector may compensate for time-front tilt. Slight asymmetry between deflector legs may be used for adjusting the scheme imperfections and misalignments.

Optionally, an intermediate lens 67 (either Einzel or TA) may be arranged to surround two adjacent ion trajectories. The arrangement allows minor additional focusing and/or steering of ion rays, preferably set at long focal distance (say above 5-10 m).

The tuning steps of the mass analyser will now be described.

(1) At start, OA tilt angle $\beta$ may be preliminary chosen from optimal ion beam energy and for the desired number of ion reflections N. The dual deflector 68 and TA-lens 67 may be set up at simulated voltages, while lens 67 may be either omitted or not energized;

(2) The pair of tilted OA 64 and deflector 40 may be tuned for reaching both time-front recovery for $\gamma=0$, and adjusting angle $\alpha_1$ (for N reflections) by adjusting source bias $U_Z$ and steering angle $\psi$, Such tuning also compensates for some instrumental misalignments;

(3) Spatial focusing of ion packets onto the detector 17 may be achieved by independent tuning of Matsuda plate potential in deflector 40 at negligible shifts of step (2) tuning;

(4) Further optimizing tuning of the optional lens 69, or of the slight imbalance of the dual deflector 68 may be figured out experimentally.

A numerical example will now be described again referring to FIG. 6. Embodiment 60 has been simulated for $D_X$=450 mm, $D_Z$=250 mm, $U_X$=8 kV, and $U_Z$=80V corresponding to $\alpha_0$=100 mrad. Ion rays are folded at $\alpha_1$=16 mrad corresponding to $L_Z$=6 mm ion packet advance per reflections. Spatial compression of TA-lens C=2. Then the OA tilt angle $\beta=(\alpha_0-\alpha_1)/(1+C)$=26 mrad and the deflector steering angle $\psi=C*\beta$=52 mard. Lens 69 is not energized. With N=30 reflections, flight path becomes L=13.5 m and flight time T=360 us for 1000 amu ions, thus setting $R=T/2\Delta T$=90,000 resolution limit when using non stressed detectors with $\Delta T$=2 ns time spread. The resolution exceeds the target R=80,000 for LC-MS, i.e. sufficient for resolving most of isobaric interferences at m/z<1000.

Various embodiments of the present invention therefore include a novel injection mechanism that has a built-in and not before fully appreciated virtue—an ability to compensate for mechanical imperfections of MPTOF mass analysers by electrical tuning of the instrument by adjusting of ion beam energies $U_Z$, and deflector 40 steering angle.

As described in relation to FIG. 6, a dual set of deflectors is proposed to cause ions to bypass detector rims and to provide for an additional mean for instrument tuning and adjustments.

Telescopic spatial focusing is also arranged by a pair of compensated deflectors, where at least one deflector may be a transaxial (TA) lens/wedge, mutually optimized with the exit lens of gridless OA. A new method is discovered for mutual compensation of the time front tilt in pair of deflectors at spatial focusing/defocusing between them.

Figure 7:
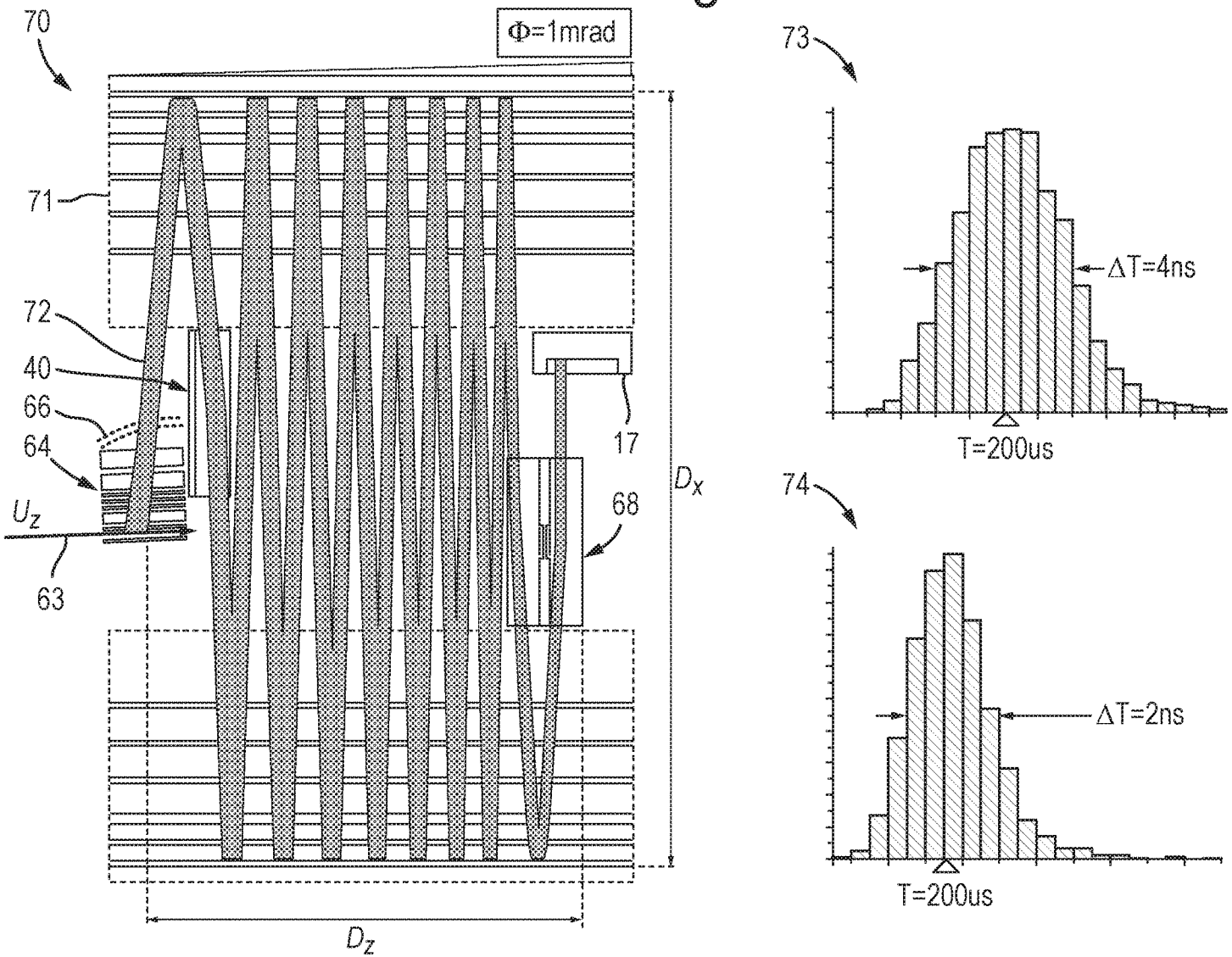
FIG. 7 illustrates a method of global compensation of instrumental misalignments and presents results of ion optical simulations, confirming recovery of the MRTOF isochronicity.

Referring to FIG. 7, there are shown results of optical simulations for an exemplary MRTOF mass analyser 70, employing the MRTOF mass analyser of FIG. 6 with $D_X$=450 mm, $D_Z$=250 mm, and U=8 kV. The mass analyser 70 is different from mass analyser 60 by introducing a $\Phi$=1 mrad tilt of the entire top mirror 71, representing a typical non intentional mechanical fault at manufacturing. If using the tuning settings of FIG. 6, resolution drops to 25,000 as shown in the graph 73. The resolution may be recovered to approximately R=50,000 as shown in icon 74 by increasing specific energy of continuous ion beam from $U_Z$=57V to $U_Z$=77V, and by retuning deflectors 40 and 68. Mass analyser 70 shows ion rays after the compensation when accounting for all realistic ion beam and ion packet spreads. Thus, simulations have confirmed that the novel method of compensating instrumental misalignments is valid.

An important improvement is provided with the novel method of global compensation of parasitic time-front tilts, produced by unintentional instrumental misalignments. Additional compensating tilt is produced by first deflector (in pair with adjustments of ion beam energy) and by tuning the imbalance of the exit dual deflector.

Referring back to FIG. 3, tilting of ion mirrors produces an additional parasitic tilt of time front 15, producing the major negative effect of instrumental misalignments. Referring back to FIG. 5, ion steering in deflector 40 allows varying the time front tilt $\gamma$ by changing the 40 deflection angle $\psi$, thus compensating overall parasitic tilts for initially wide and parallel ion packets. To recover the desired inclination angle $\alpha_1$ of ion rays, one shall adjust ion beam specific energy $U_Z$. Shifting energy may affect the ion admission from OA 64 to deflector 40. To solve this problem, one may either use a longer OA (preferably combined with entrance slit in deflector 40) or apply an additional ray steering with TA lens/wedge 66. The first part of the method, however, does not compensate the time-front tilt for point-sized and initially diverging ion packets, since they have negligible width in the deflector 40. This problem is solved by misbalance in deflector 68 legs. Thus, the novel method of FIG. 7 provide for the overall compensation of parasitic time-front tilts by any type of instrumental misalignments, while solving the problem for both components of ion packet phase space volume—initial width and initial divergence.

Yet another improvement in compact trajectory folding is arranged with the novel mechanism and method of rear-edge Z-reflection, illustrated on the example of a sector MTTOF mass analyser, though being equally applicable to MRTOF mass analysers.

Figure 8:
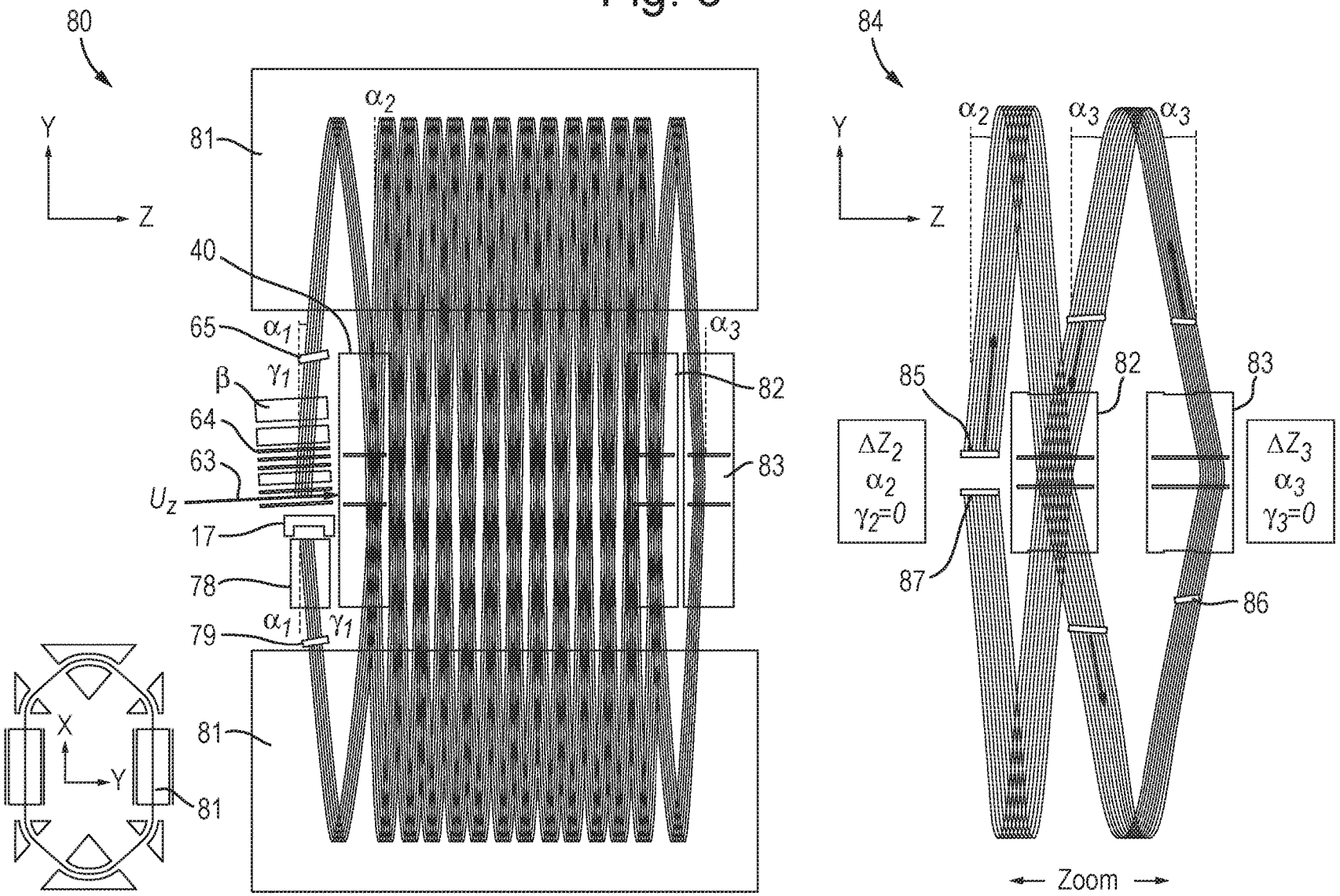
FIG. 8 shows a mechanism and method of an embodiment of the present invention for compensated reversal of ion drift motion, in a sector MTTOF instrument.

FIG. 8 shows an embodiment 70 of an MPTOF mass analyser of the present invention comprising: a sector multi-turn analyzer 81 (also shown in X-Y plane) with two-dimensional fields, i.e. without laminations of embodiment 20; a tilted OA 64; a compensated deflector 40, a pair of telescopic compensated deflectors 82 and 83; and a compensated deflector 78 in-front of a detector 17.

Similar to FIG. 5-7, ion injection employs tilted OA 64 and compensated deflector 40 for using elevated energies $U_Z$ of ion beam, reducing inclination angle to $\alpha_2$ while keeping the time front parallel to the Z-axis $\gamma_2$=0. The analyzer 81 has zero field $E_Z$ in the Z-direction, thus, packets 85 arrive to deflector 82 at angle $\alpha_2$ and with $\gamma_2$=0.

Deflectors 82 and 83 are arranged for spatial focusing by 82 and defocusing by 83 with quadrupolar fields. The pair produces a telescopic packet compression and then expansion of ion packets Z-width by factor C: $Z_2/Z_3C$. Deflector 83 produces forward steering for angle $\psi_2$ and deflector 84—reverse steering for angle $\psi_3$. To return ion packet's 87 alignment with the Z-axis, i.e. T|Z=0 and $\gamma_2$=0, the compression factor and the steering angles are chosen as: $\psi_2=-\psi_3*C$. Thus, here is introduced yet another novel method of compensated reversal of ion drift motion in MRTOF and MTTOF.

After reverse drift in the analyzer 81, ions arrive to deflector 40 (assumed set static), change inclination angle from $\alpha_2$ to $\alpha_1$ and packets 89 have time front tilted for angle $\gamma_1$. Deflector 88 steers ion packets for $\psi=\gamma_1$ to bring time front parallel to the detector face. Matsuda plates in the deflector 88 may be adjusted to compensate for residual T|ZZ aberrations, accumulated due to analyzer imperfections or slight shift in the overall tuning.

Back end reflection nearly doubles ion path and allow yet higher resolutions and/or yet more compact analyzers.

As described in relation to FIG. 8, an improvement is provided by using telescopic focusing-defocusing deflectors for compensated rear-end reflection of ion packets in the drift direction for doubling the ion path. Optionally, similar deflection may be used for trapping ion packets for larger number of passes in so-called zoom mode.

Figure 9:
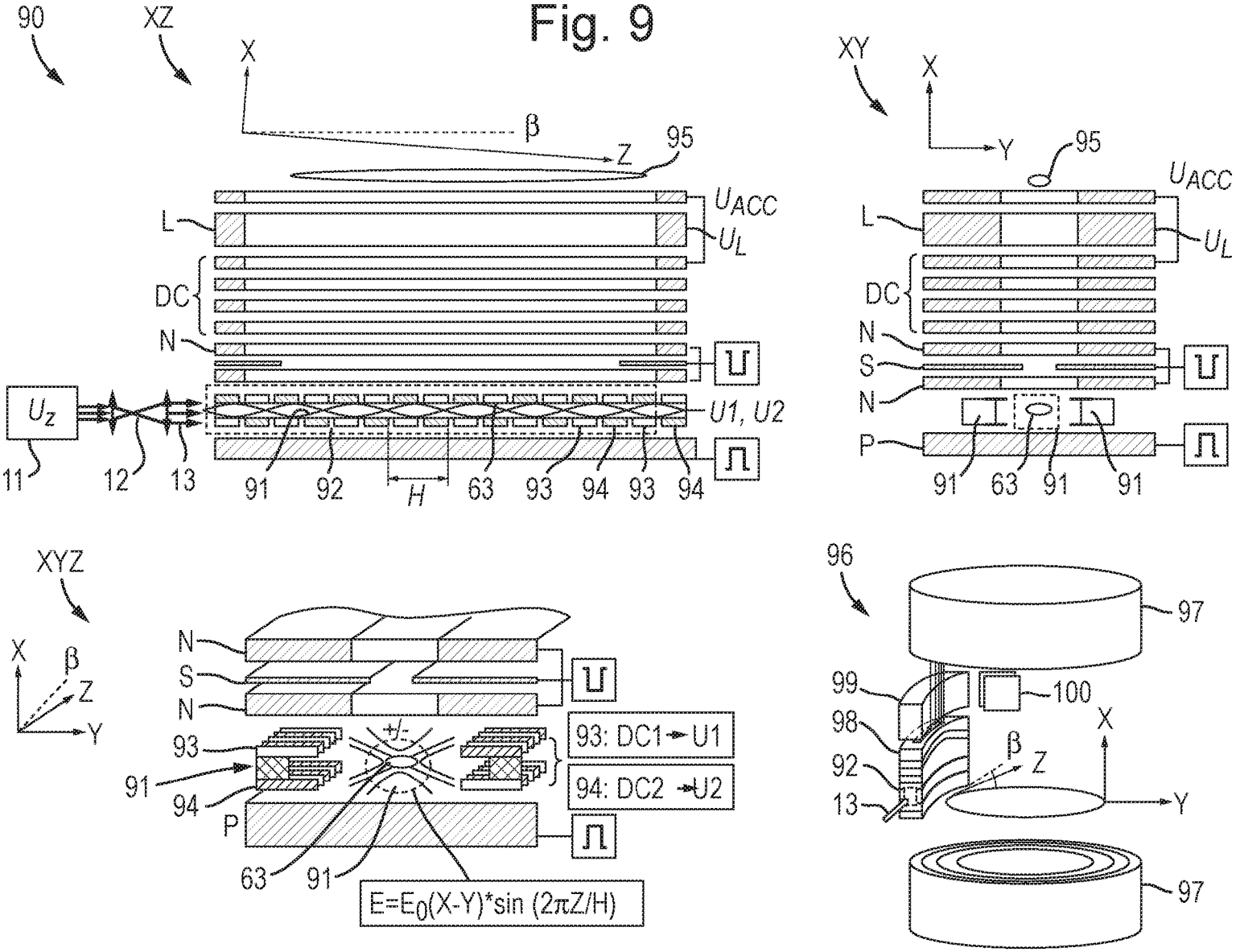
FIG. 9 shows an electrostatic ion guide for ion beam transverse confinement within elongated and optionally curved orthogonal accelerators.

FIG. 9 shows an embodiment 90 comprising a novel ion guide 91 as described in a co-pending PCT application filed the same day as this application and entitled "ION GUIDE WITHIN PULSED CONVERTERS" (claiming priority from GB 1712618.6 filed 6 Aug. 2017), the entire contents of which are incorporated herein. Guide 91 comprises four rows of spatially alternated electrodes 93 and 94, each connected to own static potential DC1 and DC2, which are switched to different DC voltages U1 and U2 at ion pulsed ejection stage out of OA. Guide 91 forms a quadrupolar field 92 in XY-planes at each Z-section, where the field is spatially alternated at Z-step equal H. The overall field 92 distribution may be approximated by:

$$E=E_0(x-y)*\sin(2\pi z/H)$$

Ion source 11, floated to bias $U_Z$ forms an ion beam 11 with about the same specific energy. Ion optics 12 forms a nearly parallel ion beam 13 with the beam diameter and divergence being optimized for ion transmission and spread within the guide 91, where the portion of beam 13 within the guide 91 is annotated as 63. Ions moving along the Z-axis, do sense time periodic quadrupolar field, and experience radial confinement. Contrary to RF fields, the effective well D(r) of the novel electrostatic confinement is mass independent:

$$D(r)=[E_0^2H^2/2\pi^2U_{Z]*(r}^2/R^2)$$

Electrostatic quadrupolar ion guide 91 may be used for improvement of the OA elongation at higher OA duty cycles, for a more accurate positioning of ion beam 63 within the OA, and for preventing the ion beam contact with OA surfaces.

FIG. 9 shows an embodiment 96 of the present invention comprises two coaxial ion mirrors 97 with a two dimensional field being curved around a circular Z-axis; orthogonal accelerator 98 tilted by angle β to the Z-axis; within OA 98, an electrostatic quadrupolar ion guide 92; and at least one deflector 99 and/or 100. OA 98, guide 92, deflectors 99 and 100 may be either moderately elongated, straight, and tangentially aligned with the circular Z-axis, or they may be curved along the circular Z-axis. The ion guide 92 retains ion beam (13 at entrance) regardless of the OA and guide 92 curvature. The energy of ion beam 13 into tilted (by angle β to the Z-axis) OA is adjusted in combination steering angles of deflectors 99 and/or 100 to provide for mutual compensation of the time front tilt angle (T|Z=0) and for compensating the chromatic angular spread (α/K=0), as in FIG. 5. Coaxial mirrors may be forming either a time-of-flight mass spectrometer MRTOF MS or an electrostatic trap mass spectrometer E-Trap MS. Within E-Trap MS, the OA 98 may be displaced from the ion oscillation surface in the Y-direction and ion packets are then returned to the 2D symmetry plane of the analyzer field. Alternatively, OA may 98 be transparent for ions oscillating within the electrostatic tarp.

Thus, improvements proposed for MPTOF MS with straight Z-axis are equally applicable to other isochronous electrostatic ion analyzers, such electrostatic traps and open traps and to other electrostatic analyzers with generally curved drift axis, such as cylindrical trap, exampled in WO2011086430, and or so-called elliptical TOF MS, exampled in US2011180702, as long as the analyzer field remains two-dimensional and the analyzer field has zero field component in the drift Z-direction.

Annotations

Coordinates and Times:

x,y,z Cartesian coordinates;

X, Y, Z—directions, denoted as: X for time-of-flight, Z for drift, Y for transverse;

$Z_0$—initial width of ion packets in the drift direction;

ΔZ—full width of ion packet on the detector;

$D_X$ and $D_Z$—used height (e.g. cap-cap) and usable width of ion mirrors

L—overall flight path

N—number of ion reflections in mirror MRTOF or ion turns in sector MTTOF u-x—component of ion velocity;

w-z—component of ion velocity;

T—ion flight time through TOF MS from accelerator to the detector;

ΔT—time spread of ion packet at the detector;

Potentials and Fields:

U—potentials or specific energy per charge;

$U_Z$ and $\Delta U_Z$—specific energy of continuous ion beam and its spread;

$U_X$ acceleration potential for ion packets in TOF direction;

K and ΔK—ion energy in ion packets and its spread;

δ=ΔK/K—relative energy spread of ion packets;

E—x-component of accelerating field in the OA or in ion mirror around "turning" point;

μ=m/z—ions specific mass or mass-to-charge ratio;

Angles:

α—inclination angle of ion trajectory relative to X-axis;

Δα—angular divergence of ion packets;

γ—tilt angle of time front in ion packets relative to Z-axis

λ—tilt angle of "starting" equipotential to axis Z, where ions either start accelerating or are reflected within wedge fields of ion mirror θ—tilt angle of the entire ion mirror (usually, unintentional);

φ—steering angle of ion trajectories or rays in various devices;

ψ—steering angle in deflectors

ε—spread in steering angle in conventional deflectors;

Aberration Coefficients

T|Z, T|ZZ, T|δ, T|δδ, etc;

indexes are defined within the text

Although the present invention has been describing with reference to preferred embodiments, it will be apparent to those skilled in the art that various modifications in form and detail may be made without departing from the scope of the present invention as set forth in the accompanying claims.

The invention claimed is:

1. A mass spectrometer comprising:

a multi-pass time-of-flight mass analyzer or electrostatic ion trap having an orthogonal accelerator and electrodes arranged and configured so as to provide an ion drift region that is elongated in a drift direction (z-dimension) and to reflect or tum ions multiple times in an oscillating dimension (x-dimension) that is orthogonal to the drift direction; and an ion deflector located downstream of said orthogonal accelerator, and that is configured to back-steer an average ion trajectory of the ions passing through the ion deflector, in the drift direction, and to generate a quadrupolar field for controlling the spatial focusing of the ions in the drift direction.

2. The spectrometer of claim 1, wherein:

(i) the multi-pass time-of-flight mass analyser is a multi-reflecting time of flight mass analyser having two ion mirrors that are elongated in the drift direction (z-dimension) and configured to reflect ions multiple times in the oscillation dimension (x-dimension), wherein the orthogonal accelerator is arranged to receive ions and accelerate them into one of the ion mirrors; or (ii) the multi-pass time-of-flight mass analyser is a multi-tum time of flight mass analyser having at least two electric sectors configured to tum ions multiple times in the oscillation dimension (x-dimension), wherein the orthogonal accelerator is arranged to receive ions and accelerate them into one of the sectors.

3. The spectrometer of claim 1, wherein the ion deflector is configured to generate a substantially quadratic potential profile in the drift direction.

4. The spectrometer of claim 1, wherein the ion deflector back steers all ions passing therethrough by the same angle; and/or wherein the ion deflector controls the spatial focusing of the ion packet in the drift direction such that the ion packet has substantially the same size in the drift dimension when it reaches an ion detector in the spectrometer as it did when it enters the ion deflector.

5. The spectrometer of claim 1, wherein the ion deflector controls the spatial focusing of the ion packet in the drift direction such that the ion packet has a smaller size in the drift dimension when it reaches a detector in the spectrometer than it did when it entered the ion deflector.

6. The spectrometer of claim 1, comprising at least one voltage supply configured to apply one or more first voltage to one or more electrode of the ion deflector for performing said back-steer and one or more second voltage to one or more electrode of the ion deflector for generating said quadrupolar field for said spatial focusing, wherein the one or more first voltage is decoupled from the one or more second voltage.

7. The spectrometer of any preceding claim 1, wherein the ion deflector comprises at least one plate electrode arranged substantially in the plane defined by the oscillation dimension and the dimension orthogonal to both the oscillation dimension and the drift direction (X-Y plane), wherein the plate electrode is configured back-steer the ions; and wherein the ion deflector comprises side plate electrodes arranged substantially orthogonal to the opposing electrodes and that are maintained at a different potential to the opposing electrodes for controlling the spatial focusing of the ions in the drift direction.

8. The spectrometer of claim 1, wherein said ion deflector is configured to provide said quadrupolar field by comprising one or more of: (i) a trans-axial lens/wedge; (iii) a deflector with aspect ratio between deflecting plates and side walls of less than 2; (iv) a gate shaped deflector; or (v) a torroidal deflector.

9. The spectrometer of claim 1, wherein the ion deflector focusses the ions in a y-dimension that is orthogonal to the drift direction and the oscillation dimension, and wherein the orthogonal accelerator and/or mass analyser or electrostatic ion trap is configured to compensate for this focusing.

10. The spectrometer of any preceding claim 1, wherein the ion deflector is arranged such that it receives ions that have already been reflected or turned in the oscillation dimension by the multi-pass time-of-flight mass analyser or electrostatic ion trap;

optionally after the ions have been reflected or turned only a single time in the oscillation dimension by the multi-pass time-of-flight mass analyzer or electrostatic ion trap.

11. The spectrometer of claim 1, wherein said orthogonal accelerator is arranged and configured to receive ions along an ion receiving axis that is tilted at an angle to the drift direction, in a plane defined by the drift direction and the oscillation dimension (XZ-plane), and to pulse the ions orthogonally to the ion receiving axis such that the time front of the ions exiting the orthogonal accelerator is parallel to the ion receiving axis; and wherein the ion deflector is configured to back-steer the ions, in the drift direction, such that the time front of the ions becomes parallel, or more parallel, to the drift dimension and/or an impact surf ace of an ion detector after the ions exit the ion deflector.

12. The spectrometer of claim 11, wherein the ion receiving axis is tilted at an acute tilt angle $\beta$ to the drift direction; wherein the ion deflector back steers ions passing therethrough by a back-steer angle $|\beta|'$, and wherein the tilt angle and back-steer angle are the same.

13. The spectrometer of claim 1, comprising an ion optical lens for spatially focusing or compressing the ion packet in the drift direction, wherein the ion deflector is configured to defocus the ion packet in the drift direction, and wherein the combination of the ion optical lens and ion deflector are configured to provide telescopic compression of the ion beam.

14. The spectrometer of claim 1, comprising an ion optical lens for compressing the ion packet in the drift direction by a factor C;

wherein said orthogonal accelerator is arranged and configured to receive ions along an ion receiving axis that is tilted at an angle $\beta$ to the drift direction, in a plane defined by the drift direction and the oscillation dimension (XZ-plane);

wherein the ion deflector is configured to back-steer the ions, in the drift direction, by angle $\psi$, and wherein $\beta=\psi/C$.

15. The spectrometer of claim 1, comprising a further ion deflector proximate an ion detector in the spectrometer for deflecting an average ion trajectory passing through the ion deflector such that ions are guided onto a detecting surface of the ion detector.

16. A method of mass spectrometry comprising:

providing the spectrometer of any preceding claim 1;

transmitting ions into the orthogonal accelerator along an ion receiving axis;

accelerating the ions orthogonally to the ion receiving axis in the orthogonal accelerator; and deflecting the ions downstream of said orthogonal accelerator so as to back-steer the average ion trajectory of the ions, in the drift direction, and controlling the spatial focusing of the ions in the drift direction with the quadrupolar field;

wherein the ions are oscillated multiple times in the oscillation dimension by the multipass time-of-flight mass analyser or electrostatic ion trap as the ions drift through the drift region in the drift direction.

* * * * *